US010145537B2

(12) United States Patent
Watanabe et al.

(10) Patent No.: US 10,145,537 B2
(45) Date of Patent: Dec. 4, 2018

(54) ILLUMINATION UNIT AND VEHICLE LAMP

(71) Applicant: KOITO MANUFACTURING CO., LTD., Tokyo (JP)

(72) Inventors: Ken Watanabe, Shizuoka (JP); Hiromi Nakamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 220 days.

(21) Appl. No.: 14/729,443

(22) Filed: Jun. 3, 2015

(65) Prior Publication Data

US 2015/0345740 A1 Dec. 3, 2015

(30) Foreign Application Priority Data

Jun. 3, 2014 (JP) ..... 2014-114685
Apr. 13, 2015 (JP) ..... 2015-081925

(51) Int. Cl.

| | |
|---|---|
| ***F21V 7/00*** | (2006.01) |
| ***F21S 43/19*** | (2018.01) |
| ***F21S 43/14*** | (2018.01) |
| ***F21S 43/30*** | (2018.01) |
| *F21Y 107/20* | (2016.01) |

(52) U.S. Cl.
CPC ..... *F21V 7/0025* (2013.01); *F21S 43/14* (2018.01); *F21S 43/195* (2018.01); *F21S 43/30* (2018.01); *F21Y 2107/20* (2016.08)

(58) Field of Classification Search
CPC . F21S 48/2225; F21S 48/2243; F21S 48/2268
See application file for complete search history.

(56) References Cited

U.S. PATENT DOCUMENTS

| | | | | |
|---|---|---|---|---|
| 6,502,975 | B1 | 1/2003 | Branstetter | |
| 2005/0078486 | A1* | 4/2005 | Kawaguchi | B60Q 1/26 362/494 |
| 2006/0109657 | A1* | 5/2006 | Kuhl | B60Q 1/26 362/300 |
| 2009/0114928 | A1* | 5/2009 | Messere | B32B 17/10 257/88 |

(Continued)

FOREIGN PATENT DOCUMENTS

| | | | |
|---|---|---|---|
| CN | 102889535 | A | 1/2013 |
| EP | 2071232 | A1 | 6/2009 |

(Continued)

OTHER PUBLICATIONS

Office Action issued in counterpart Chinese Patent Application No. 2015103003966, dated May 2, 2017 (17 pages).

(Continued)

*Primary Examiner* — Zheng Song
(74) *Attorney, Agent, or Firm* — Osha Liang LLP

(57) ABSTRACT

An illumination unit includes a transparent substrate, a light source, a first half mirror, and a mirror. The light source is mounted on the transparent substrate. The first half mirror is disposed on a front side of the transparent substrate. The mirror is disposed on a rear side of the transparent substrate. Light emitted from the light source is repeatedly reflected between the first half mirror and the mirror while being transmitted through the transparent substrate, so as to be output forward from the first half mirror.

11 Claims, 17 Drawing Sheets

(56) References Cited

U.S. PATENT DOCUMENTS

| | | | | |
|---|---|---|---|---|
| 2009/0154184 | A1* | 6/2009 | King | F21S 48/1721 362/513 |
| 2011/0149585 | A1* | 6/2011 | Dubosc | F21V 13/10 362/519 |
| 2012/0170307 | A1* | 7/2012 | Eberwein | B60Q 1/26 362/602 |
| 2013/0010487 | A1* | 1/2013 | Buisson | F21S 48/115 362/516 |
| 2014/0029106 | A1* | 1/2014 | Shih | F21S 48/234 359/633 |
| 2014/0264396 | A1* | 9/2014 | Lowenthal | H01L 33/08 257/88 |
| 2015/0219908 | A1* | 8/2015 | Lee | G02B 27/22 359/463 |

FOREIGN PATENT DOCUMENTS

| | | | |
|---|---|---|---|
| EP | 2292972 | A1 | 3/2011 |
| JP | 2013-214492 | A | 10/2013 |
| WO | 2007079005 | A2 | 7/2007 |

OTHER PUBLICATIONS

Search Report issued in French Application No. 1555030, dated May 29, 2018 (8 pages).

* cited by examiner

ILLUMINATION UNIT AND VEHICLE LAMP

CROSS REFERENCE TO RELATED APPLICATION(S)

This application is based on and claims priority under 35 U.S.C. § 119 to Japanese Patent Application Nos. 2014-114685 (filed on Jun. 3, 2014) and 2015-081925 (filed on Apr. 13, 2015), the entire contents of which are incorporated herein by reference.

BACKGROUND

1. Field

Exemplary embodiments of the invention relate to an illumination unit in which a light source is mounted on a transparent substrate and a vehicle lamp provided with the illumination unit.

2. Related Art

For example, JP 2013-214492 A describes a vehicle lamp having such a configuration that a light source is mounted on a transparent substrate.

In a vehicle lamp described in a third exemplary embodiment of JP 2013-214492 A, the transparent substrate is disposed in a lamp chamber defined by a transparent cover and a lamp body. An inner surface of the lamp body is configured to be a reflecting surface. With this configuration, light which is emitted from the light source to be directed rearwards is reflected by the reflecting surface of the lamp body to be directed forward. Furthermore, part of the reflected light is reflected by the transparent substrate to be directed rearward, so that the light is then reflected again to be directed forward by the reflecting surface of the lamp body.

In the vehicle lamp described in JP 2013-214492 A, the light emitted from the light source is reflected multiple times (multiple reflection) between the transparent substrate and the reflecting surface of the lamp body, thereby making it possible to improve the appearance of the lamp when the lamp is turned on.

In the vehicle lamp which utilizes the multiple reflection technique like this, however, a further improvement in the appearance of the vehicle lamp when the lamp is turned on is desired.

A further improvement in the appearance of a general illumination unit lamp when the lamp is turned on is also desired as well as the vehicle lamp.

SUMMARY

Exemplary embodiments of the invention have been made in view of the above circumstances and provide (i) an illumination unit which includes a light source mounted on a transparent substrate and which can improve its appearance when the illumination unit is turned on and (ii) a vehicle lamp including the illumination unit.

In one exemplary embodiment a half mirror and a mirror which are disposed to have a predetermined positional relationship are provided to offer the above described illumination unit and the vehicle lamp.

(1) According to one exemplary embodiment, an illumination unit includes a transparent substrate, a light source, a first half mirror, and a mirror. The light source is mounted on the transparent substrate. The first half mirror is disposed on a front side of the transparent substrate. The mirror is disposed on a rear side of the transparent substrate. Light emitted from the light source is repeatedly reflected between the first half mirror and the mirror while being transmitted through the transparent substrate, so as to be output forward from the first half mirror.

Application of the "illumination unit" is not particularly limited, so long as the illumination unit is configured so that the light source is mounted on the transparent substrate.

The configuration of the "transparent substrate" is not particularly limited, so long as the substrate has transparency with respect to light. For example, a transparent or opaque wiring pattern may be formed on a surface of a transparent substrate or in an interior of a transparent substrate.

A type of the "light source" is not particularly limited, so long as the light source is mounted on the transparent substrate. Examples of the "light source" include a light emitting diode and an organic EL element. The number of light sources may be one or more.

So long as the "first half mirror" and the "mirror" are disposed so as to have such a positional relationship that the light emitted from the light source can be repeatedly reflected between the "first half mirror" and the "mirror" while the light is transmitted through the transparent substrate, a positional relationship between the first half mirror, the mirror, and the transparent substrate is not particularly limited.

As shown in the configuration described above, the illumination unit of (1) is configured as follows. That is, the first half mirror is disposed on the front side of the transparent substrate on which the light source is mounted. The mirror is disposed on the rear side of the transparent substrate. Also, the light emitted from the light source is repeatedly reflected between the first half mirror and the mirror while being transmitted through the transparent substrate, so as to be output forward from the first half mirror. Therefore, the following advantageous effects can be obtained.

That is, when the illumination unit which is turned on is observed from the outside, the light which is reflected multiple times between the first half mirror and the mirror causes an image of the light source to look as if a number of shining images of light sources are aligned in a front-and-rear direction.

Accordingly, the appearance of the illumination unit—in which the light source is mounted on the transparent substrate—when turned on can be improved.

Moreover, by adopting this configuration, when the illumination unit which is not turned on is observed from the outside, the transparent substrate and the light source mounted thereon are hidden behind the first half mirror so as to be invisible from the outside. Thus, the appearance of the illumination unit can be further improved not only when the illumination unit is turned on but also when it is not turned on.

(2) The illumination unit of (1) may further include a first transparent member. The first transparent member is disposed between the transparent substrate and the first half mirror. The first transparent member is disposed so that a first surface of the first transparent member is in contact with the transparent substrate and a second surface of the first transparent member is in contact with the first half mirror.

(3) The illumination unit of (1) may further include a second transparent member. The second transparent member is disposed between the transparent substrate and the mirror. The second transparent member is disposed so that a first surface of the second transparent member is in contact with the transparent substrate and a second surface of the second transparent member is in contact with the mirror.

(4) The illumination unit of (1) may further include a first transparent member and a second transparent member. The first transparent member is disposed between the transparent substrate and the first half mirror. The second transparent member is disposed between the transparent substrate and the mirror. The first transparent member is disposed so that a first surface of the first transparent member is in contact with the transparent substrate and a second surface of the first transparent member is in contact with the first half mirror. The second transparent member is disposed so that a first surface of the second transparent member is in contact with the transparent substrate and a second surface of the second transparent member is in contact with the mirror.

With the configurations of (2) to (4), a distance between the transparent substrate and the first half mirror and/or a distance between the transparent substrate and the mirror can easily be maintained constant. As this occurs, it is also possible to form the first half mirror and/or the mirror by applying a metal deposition on the second surface of the transparent member.

(5) The illumination unit of any of (2) to (4) may further include a second half mirror that is disposed between the transparent substrate and the mirror.

With this configuration, when the illumination unit which is turned on is observed from the outside, (i) the light which is reflected multiple times between the first half mirror and the mirror and (ii) the light which is reflected multiple times between the first half mirror and the second half mirror cause the image of the light source to look as if a number of shining images of light sources are aligned in the front-and-rear direction.

(6) In the illumination unit of (5), the transparent substrate, the first half mirror, and the second half mirror may extend along a predetermined curved surface. End portions of the transparent substrate, end portions of the first half mirror, and end portions of the second half mirrors may be fixed to the mirror.

With this configuration, the light which is reflected multiple times between the first half mirror and the second half mirror causes the image of the light source to look as if a number of shining images of light sources are aligned in a direction which is at right angles to the predetermined curved surface. Also, the mirror causes the image of the light source to look as if the number of images of the light sources increase multiple times in brightness.

(7) According to another exemplary embodiment, a vehicle lamp includes the illumination unit of any one of (1) to (6), a transparent cover, and a lamp body. The transparent cover and the lamp body define a lamp chamber. The lamp chamber houses the illumination unit. The transparent substrate and the first half mirror extend along the transparent cover.

When the illumination unit which is not turned on is observed from the outside, the first half mirror which is disposed on the front side of the transparent substrate enables the interior of the lamp chamber to be invisible from the outside. As this occurs, it is also possible to form the first half mirror by applying a metal deposition on the inner surface of the transparent cover.

A type of the "vehicle lamp" is not particularly limited. For example, the vehicle lamp may be a signaling lamp such as a tail lamp, a stop lamp, a turn signal lamp, a clearance lamp and the like. Alternatively, the vehicle lamp may be a lamp which is different from the signaling lamps and which is intended to be a lamp which is dedicated to a function to alert neighboring vehicles and the like. Further alternatively, the vehicle lamp may be a lamp for decoration purpose.

(8) According to another exemplary embodiment, an illumination unit includes a transparent substrate, a light source, a half mirror, and a mirror. The light source is mounted on a transparent substrate. The half mirror is disposed on a rear side of the transparent substrate. The mirror is disposed on a rear side of the half mirror.

When the illumination unit which is turned on is observed from the outside, the light which is reflected on the half mirror and the light which is reflected multiple times between the half mirror and the mirror cause an image of the light source to look as if a number of shining images of light sources are arranged in the front-and-rear direction. Consequently, when this configuration is adopted, the appearance of the illumination unit which is turned on is improved.

Moreover, depending upon the configuration of the transparent substrate on which the light source is mounted, the light source can be made inconspicuous when the illumination unit which is not turned on is observed from the outside. Thus, by adopting this configuration, the appearance of the illumination unit can be improved not only when the illumination unit is turned on but also when the illumination unit is not turned on.

(9) The illumination unit of (8) may further include a first transparent member and a second transparent member. The first transparent member is disposed between the transparent substrate and the half mirror. The second transparent member is disposed between the half mirror and the mirror.

With this configuration, a distance between the transparent substrate and the half mirror and a distance between the half mirror and the mirror can easily be maintained constant.

(10) In the illumination unit of any one of (8) to (9), the transparent substrate, the half mirror, and the mirror may extend along a curved surface that is convex toward a front side of the illumination unit.

With this configuration, the image of the light source is caused to look as if a number of shining images of light sources are aligned in radial directions.

DETAILED DESCRIPTION

Hereinafter, exemplary embodiments of the invention will be described in detail with reference to the accompanying drawings.

Figure 1:
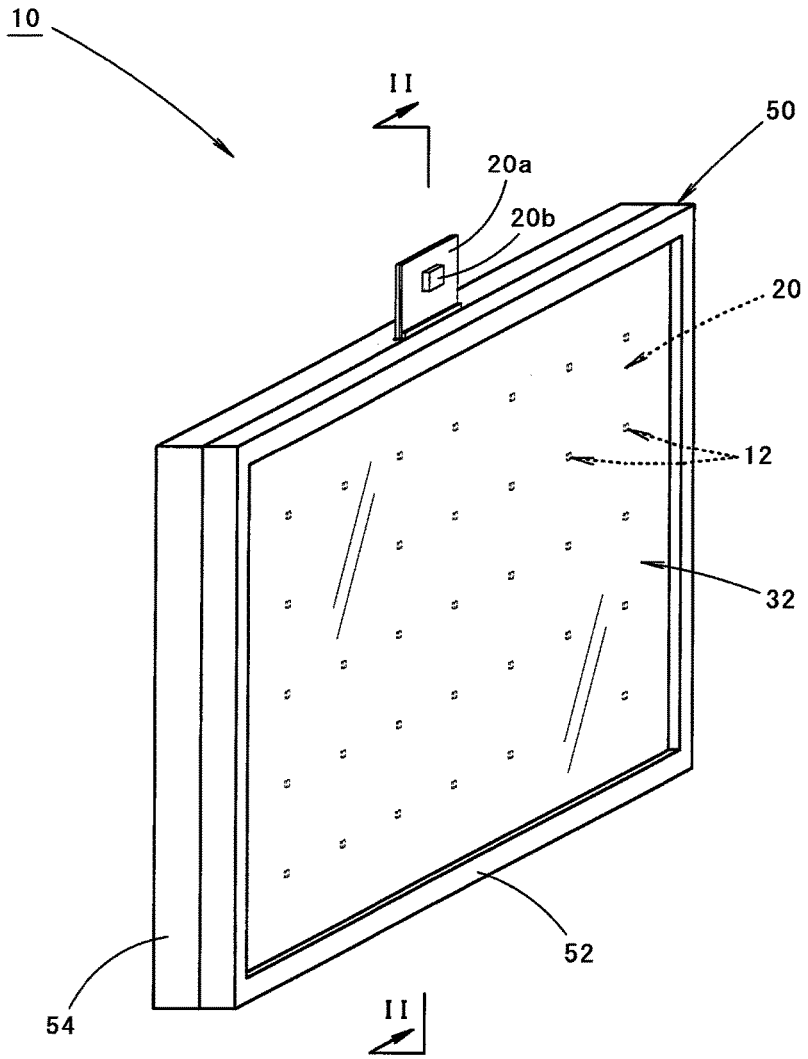
FIG. 1 is a perspective view showing an illumination unit according to a first exemplary embodiment.
Figure 2:
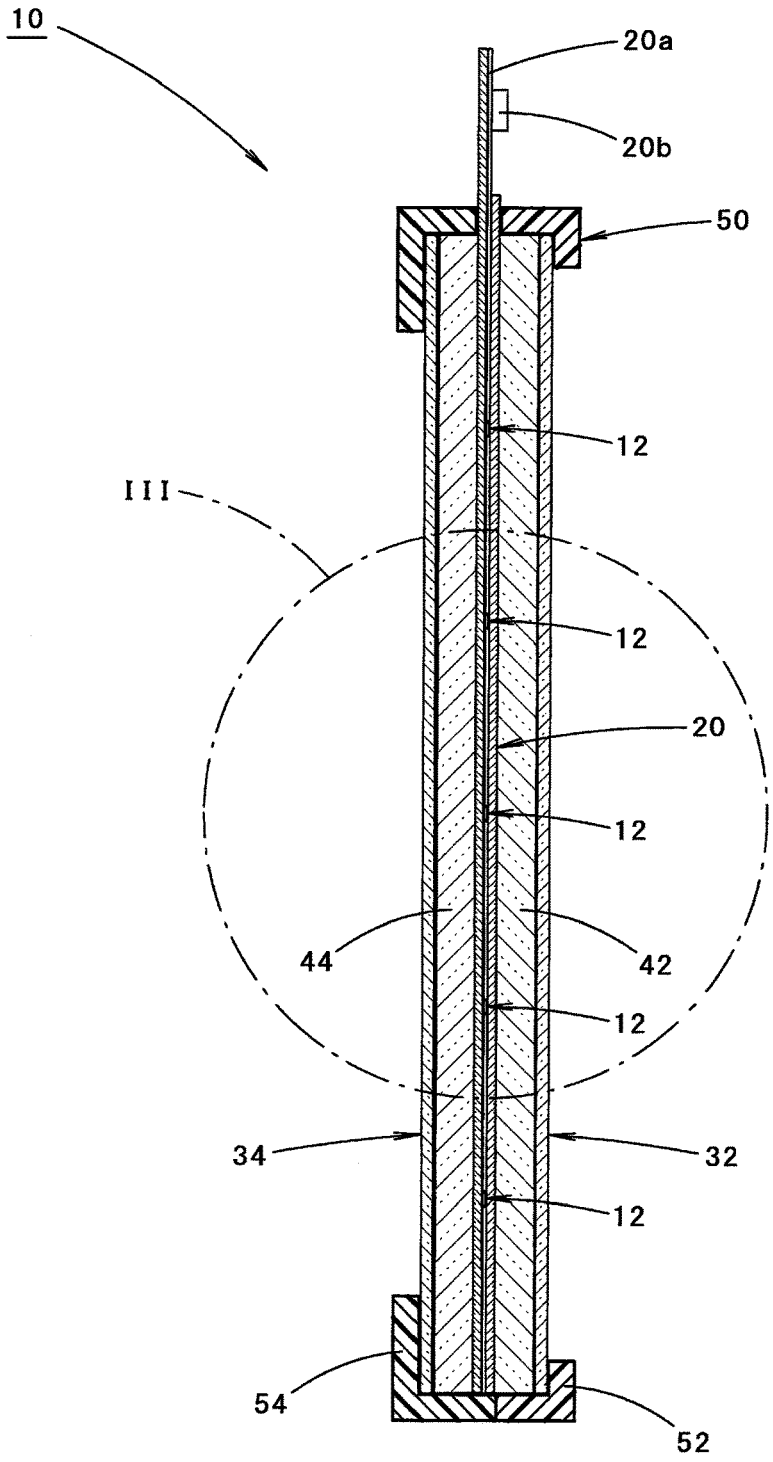
FIG. 2 is a side sectional view of the illumination unit taken along a line II-II in FIG. 1.

FIG. 1 is a perspective view showing an illumination unit 10 according to a first exemplary embodiment of the invention. FIG. 2 is a side sectional view showing the illumination unit 10 taken along a line II-II in FIG. 1.

As shown in FIGS. 1 and 2, the illumination unit 10 according to the first exemplary embodiment includes a transparent substrate 20, a plurality of light sources 12, a first half mirror 32, and a mirror 34. The transparent substrate 20 is disposed so as to extend along a vertical plane. The plurality of light sources 12 are mounted on the transparent substrate 20 so as to be disposed in a grid-like form vertically and horizontally. The first half mirror 32 is disposed on a front side of the transparent substrate 20. The mirror 34 is disposed on a rear side of the transparent substrate 20.

Figure 3:
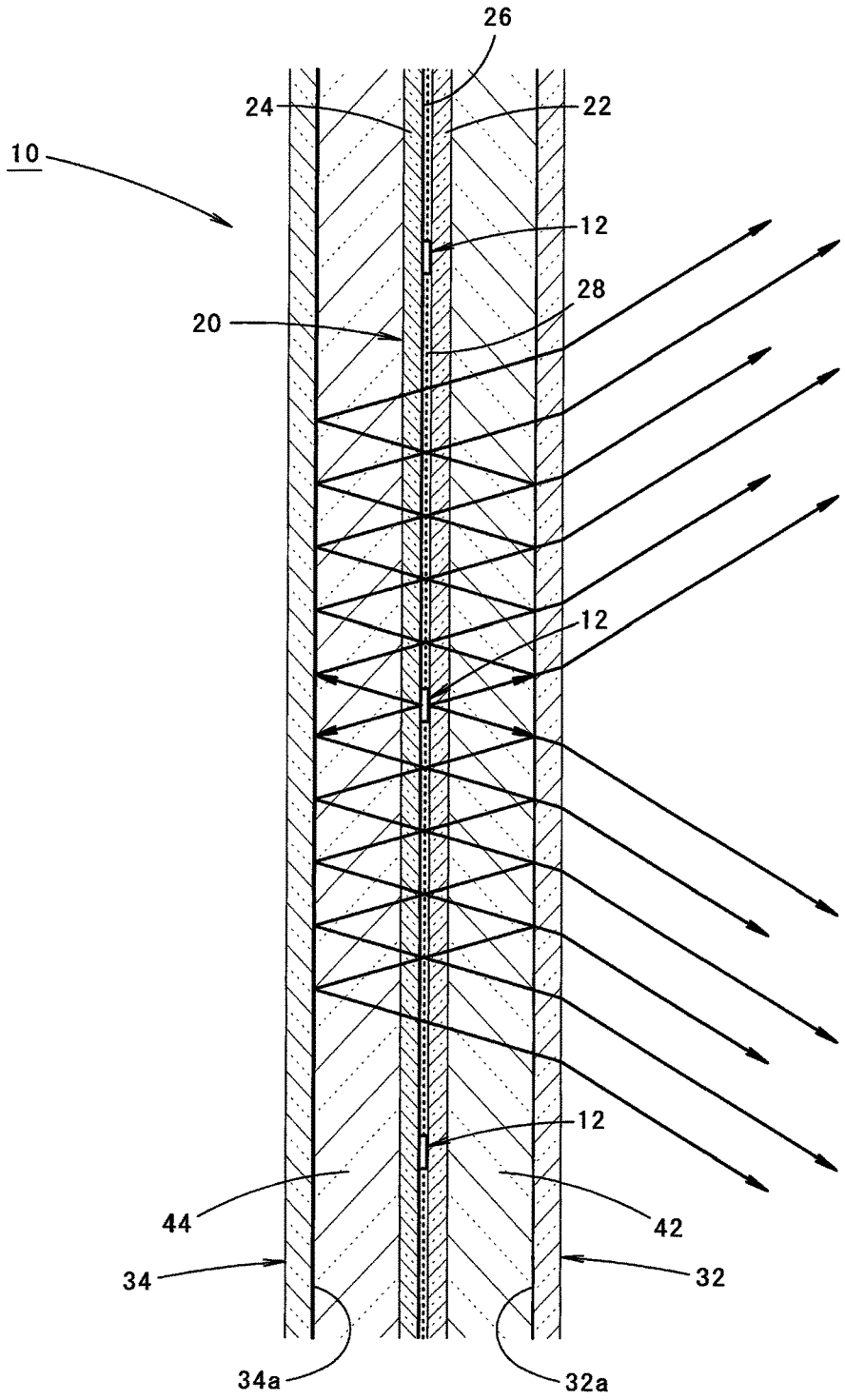
FIG. 3 is a sectional view showing in detail a portion indicated by III in FIG. 2.

FIG. 3 is a detailed view of a portion indicated by III in FIG. 2.

As shown in FIG. 2, the illumination unit 10 is configured so that light emitted from the light sources 12 is output forward from the first half mirror 32 while being repeatedly reflected between the first half mirror 32 and the mirror 34.

Next, a specific configuration of this illumination unit 10 will be described.

In this transparent substrate 20, a wiring pattern 26 is disposed between first and second transparent films 22, 24 which are made from a transparent resin (for example, from PET). The wiring pattern 26 is formed on a front surface of the second transparent film 24 which is located on a rear side of the transparent substrate 20. The wiring pattern 26 is formed by cutting a part of an opaque conductive film having a mesh shape. The first and second transparent films 22, 24 are affixed to each other via a transparent adhesive 28.

A tab 20*a* is formed at a central portion of an upper end of the transparent substrate 20 so as to project upwards. The wiring pattern 26 is exposed in the position where the tab 20*a* is provided. A terminal portion 20*b* is mounted on the wiring pattern 26.

Each light source 12 is light emitting diodes which emit red light and includes a light emitting chip having light emitting surfaces on both front and rear surfaces thereof. The light sources 12 are fixed to the wiring pattern 26 so as to establish an electrical communication therebetween while being disposed between the first and second transparent films 22, 24.

The first half mirror 32 and the mirror 34 are disposed so as to extend along the vertical plane and located at an equal distance from the transparent substrate 20. The first half mirror 32 is a film made from a transparent resin (for example, PET). A metal deposition process or the like is applied to a rear surface of the first half mirror 32 so that the rear surface of the first half mirror 32 serves as a half mirror surface 32*a*. On the other hand, the mirror 34 is also a film made from a transparent resin (for example PET). A metal deposition process or the like is applied to a front surface of the mirror 34 so that the front surface of the mirror 34 serves as a mirror surface 34*a*.

A transparent member 42 is disposed between the transparent substrate 20 and the first half mirror 32. The transparent member 42 is a plate-shaped member made from a transparent resin (for example, PET) and has a constant thickness. The transparent member 42 is disposed so that a rear surface thereof is in contact with the transparent substrate 20 and a front surface thereof is in contact with the first half mirror 32. Thereby, the transparent member 42 is affixed to the transparent substrate 20 and the first half mirror 32.

Also, a transparent member 44 is disposed between the transparent substrate 20 and the mirror 34. The light transmitting member 44 is a plate-shaped member made from a transparent resin (for example, PET) and has a constant thickness. The transparent member 44 is disposed so that a front surface thereof is in contact with the transparent substrate 20 and a rear surface thereof is in contact with the mirror 34. Thereby, the transparent member 44 is affixed to the transparent member 20 and the mirror 34.

The transparent substrate 20 has a frame 50. The frame 50 is disposed along outer circumferential edge portions of the first half mirror 32, the mirror 34 and the transparent members 42, 44 so as to surround the first half mirror 32, the mirror 34 and the transparent members 42, 44. The frame 50 includes a first frame portion 52 and a second frame portion 54. The second frame portion 54 supports the transparent substrate 20 and the like from the rear side thereof. The tab 20*a* of the transparent substrate 20 passes through the second frame portion 54 at an upper portion thereof. On the other hand, the first frame portion 52 is fixed to the second frame portion 54 in a state where the first frame portion 52 supports the transparent substrate 20 from the front thereof.

Figure 4:
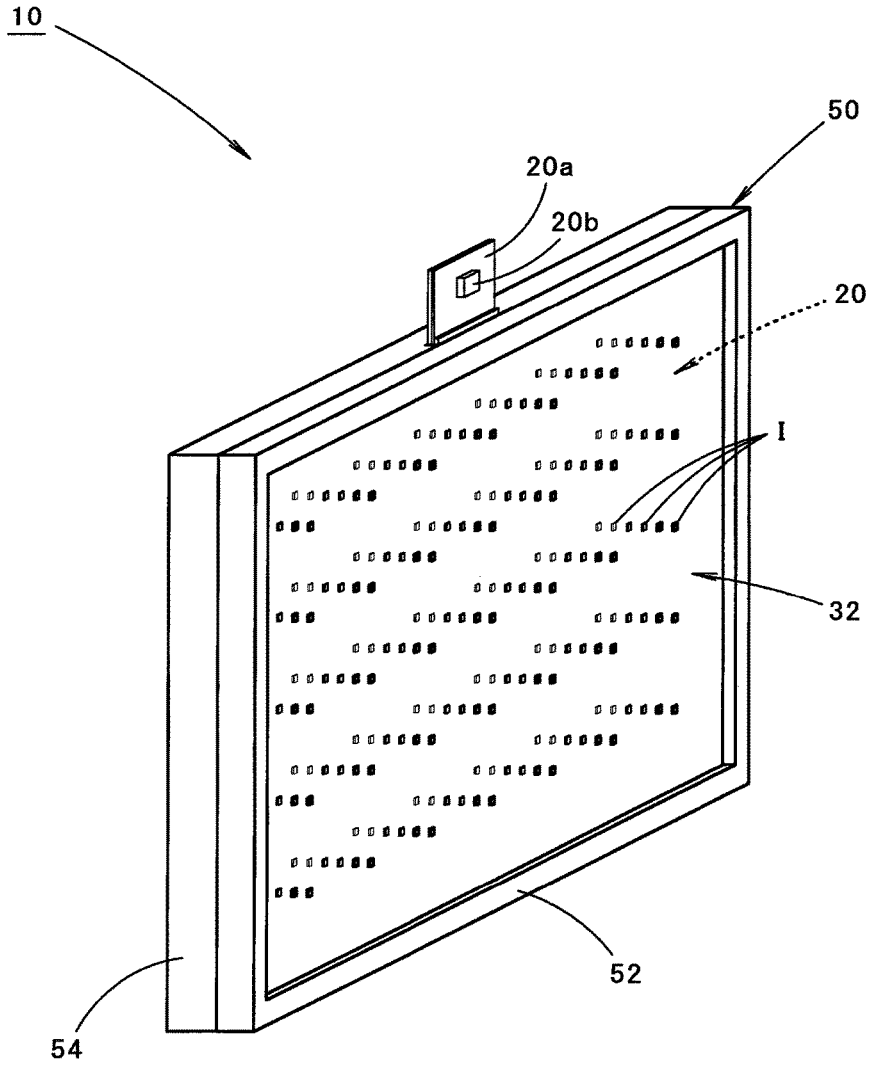
FIG. 4 is a similar view to FIG. 1 and shows how the illumination unit of the first exemplary embodiment operates.

FIG. 4 is a perspective view showing a state in which the light sources 12 are turned on.

As shown in FIG. 4, when the illumination unit 10 which is turned on is observed from the outside, light which is reflected multiple times between the first half mirror 32 and the mirror 34 causes an image I of each light sources 12 to look as if a number of shining images of light sources are aligned in a front-and-rear direction at a plurality of locations.

On the other hand, as shown in FIG. 1, when the illumination unit 10 which is not turned on is observed from the outside, since outside light is reflected by the first half mirror 32, the transparent substrate 20 and the light sources 12 are almost invisible.

Next, description will be given on how the illumination unit 10 of the first exemplary embodiment operates.

As has been described in detail heretofore, the illumination unit 10 according to the first exemplary embodiment is configured so that the first half mirror 32 is disposed on the front side of the transparent substrate 20 on which the plurality of light sources 12 are mounted, while the mirror 34 is disposed on the rear side of the transparent substrate 20. Therefore, light emitted from the light sources 12 which is emitted forward from the first half mirror 32 while being repeatedly reflected between the first half mirror 32 and the mirror 34 so as to be transmitted through the transparent substrate 20. Thus, the following advantageous effects are obtained.

Namely, when the illumination unit 10 which is turned on is observed from the outside, the light which is reflected multiple times between the first half mirror 32 and the mirror 34 causes the image I of each light source 12 to looks as if a number of shining images of light source are aligned in the front-and-rear direction. On the other hand, when the illumination unit 10 which is not turned on is observed from the outside, the transparent substrate 20 and the light sources 12 mounted on the transparent substrate 20 can be hidden behind the first half mirror 32 so as to be invisible from the outside.

According to the first exemplary embodiment, the appearance of the illumination unit 10 in which the plurality of light sources 12 are mounted on the transparent substrate 20 can be improved not only when the illumination unit 10 is turned on but also when the illumination unit 10 is not turned off.

In the first exemplary embodiment, the transparent member 42 is disposed between the transparent substrate 20 and the first half mirror 32 so that (i) the rear surface (an example of a first surface) of the transparent member 42 is in contact with the transparent substrate 20 and (ii) the front surface (an example of a second surface) of the transparent member 42 is in contact with the first half mirror 32. Therefore, a distance between the transparent substrate 20 and the first half mirror 32 can be maintained constant. Also, the transparent member 44 is disposed between the transparent substrate 20 and the mirror 34 so that (i) the front surface (an example of a first surface) of the transparent member 44 in contact with the transparent substrate 20 and (ii) the rear surface (an example of a second surface) of the transparent member 44 is in contact with the mirror 34. Therefore, a distance between the transparent substrate 20 and the mirror 34 can be maintained constant. This enables the image I of each light source 12 to look as if a number of shining images of light source are aligned accurately at constant intervals in the front-and-rear direction.

In the first exemplary embodiment, it is assumed that the plurality of light sources 12 are disposed in a grid-like form vertically and horizontally. However, any other configurations may be adopted, in place of the one described above.

Also, in the first exemplary embodiment, it is assumed that the wiring pattern 26 of the transparent substrate 20 is formed by cutting the part of the opaque conductive film having a mesh shape. However, any other configurations may be adopted, in place of the one described above. For example, the wiring pattern 26 of the transparent substrate 20 may be a transparent conductive film (for example, an ITO (Indium Tin Oxide).

Furthermore, in the first exemplary embodiment, it is assumed that the light sources 12 are the light emitting chips each having the light emitting surfaces on both the front and rear surfaces thereof. Alternatively, the light sources 12 may be light emitting chips each having a light emitting surface only on either the front surface or the rear surface thereof.

Next, modification examples of the first exemplary embodiment will be described.

Firstly, a first modification example of the first exemplary embodiment will be described.

Figure 5:
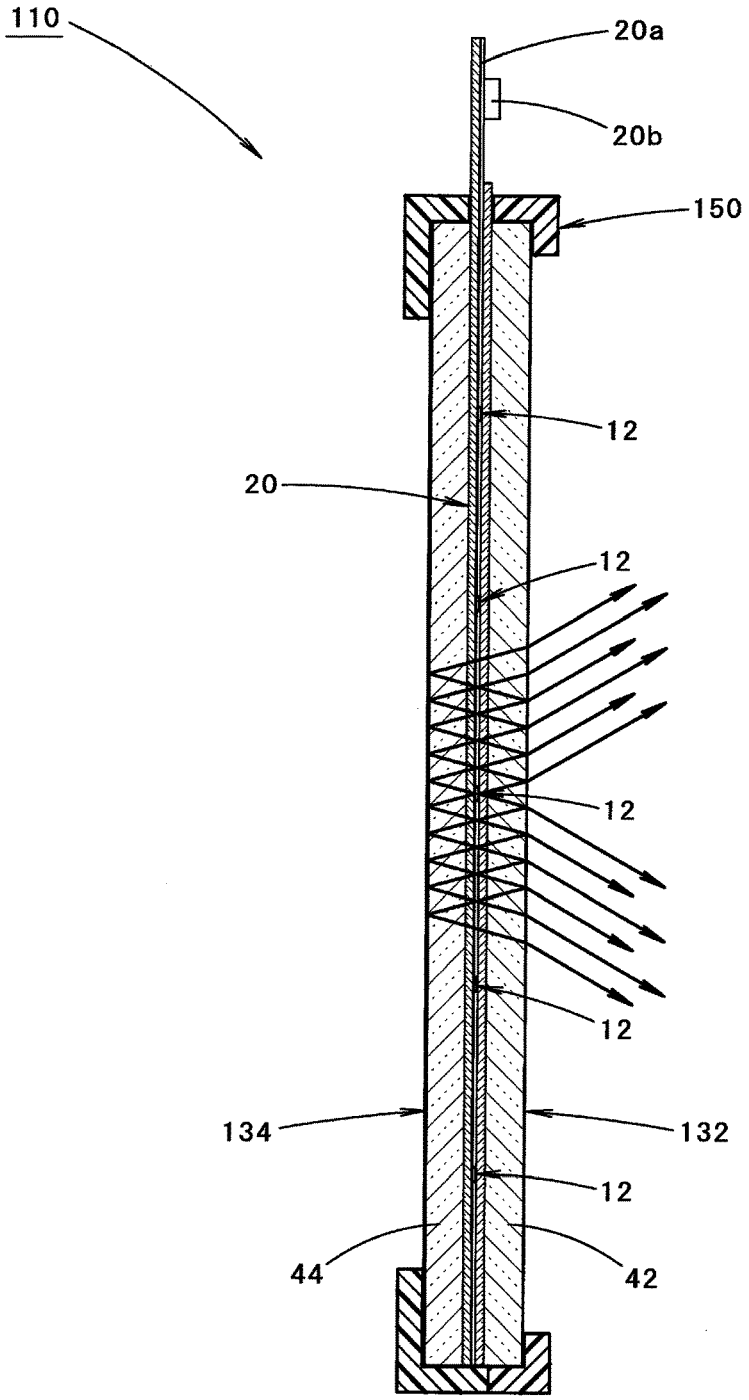
FIG. 5 is a similar view to FIG. 2 and shows an illumination unit of a first modification example of the first exemplary embodiment.

FIG. 5 is a similar view to FIG. 2 and shows an illumination unit 110 according to the first modification example.

As shown in FIG. 5, a basic configuration of this modification example is similar to that of the first exemplary embodiment. However, in this modification example, a first half mirror 132 is formed on a front surface of a transparent member 42 by applying a metal deposition process or the like thereto, and a mirror 134 is formed on a rear surface of a transparent member 44 by applying a metal deposition process or the like thereto. In association with this configuration, a shape of a frame 150 differs from that of the first exemplary embodiment.

With the configuration of this modification example, the illumination unit 110 can be made simple, and the thickness of the illumination unit 110 can be made thin.

Next, a second modification example of the first exemplary embodiment will be described.

Figure 6:
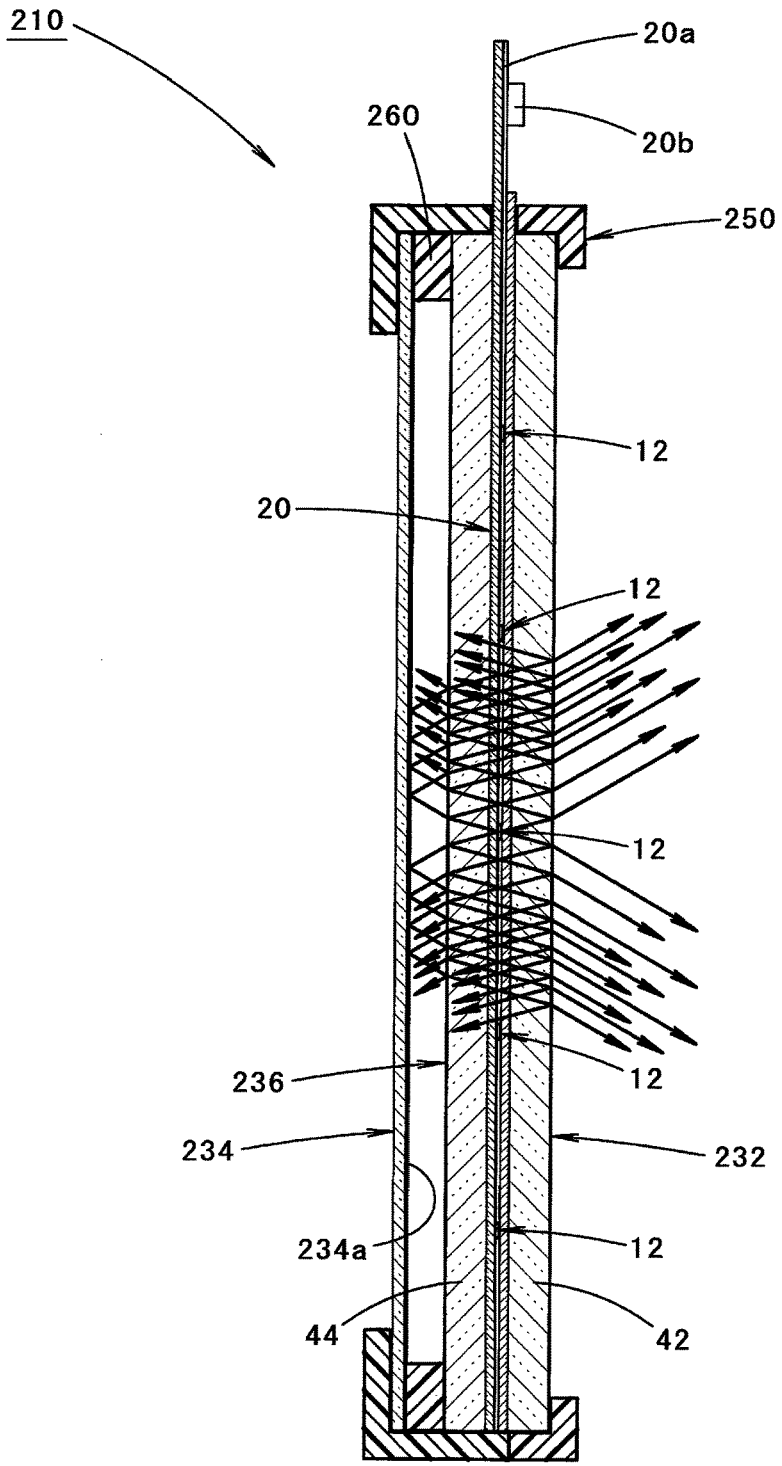
FIG. 6 is a similar view to FIG. 2 and which shows an illumination unit of a second modification example of the first exemplary embodiment.

FIG. 6 is a similar view to FIG. 2 and shows an illumination unit 210 of this modification example.

As shown in FIG. 6, a basic configuration of this modification example is similar to that of the first exemplary embodiment. However, in this modification example, a second half mirror 236 is disposed between a transparent substrate 20 and a mirror 234.

Namely, in this modification example, the mirror 234 is disposed in a position which is spaced away rearwards from a transparent member 44. A metal deposition process or the like is applied to a front surface of the mirror 234 so that the front surface of the mirror surface serves as a mirror surface 234*a*. Also, the second half mirror 236 is formed by applying a metal deposition process or the like to a rear surface of the transparent member 44. An annular spacer 260 is disposed between the transparent member 44 and the mirror 234. In association with adopting this configuration, a shape of a frame 250 partially differs from that of the first modification example.

By adopting the configuration of this modification example, when the illumination unit 210 which is turned on is observed from the outside, (i) light which is reflected multiple times between the first half mirror 232 and the mirror 234 and (ii) light reflected multiple times between the first half mirror 232 and the second half mirror 236 cause an image I of each light source 12 to look as if a greater number of shining images of light sources are aligned in the front-and-rear direction.

Next, a third modification example of the first exemplary embodiment will be described.

Figure 7:
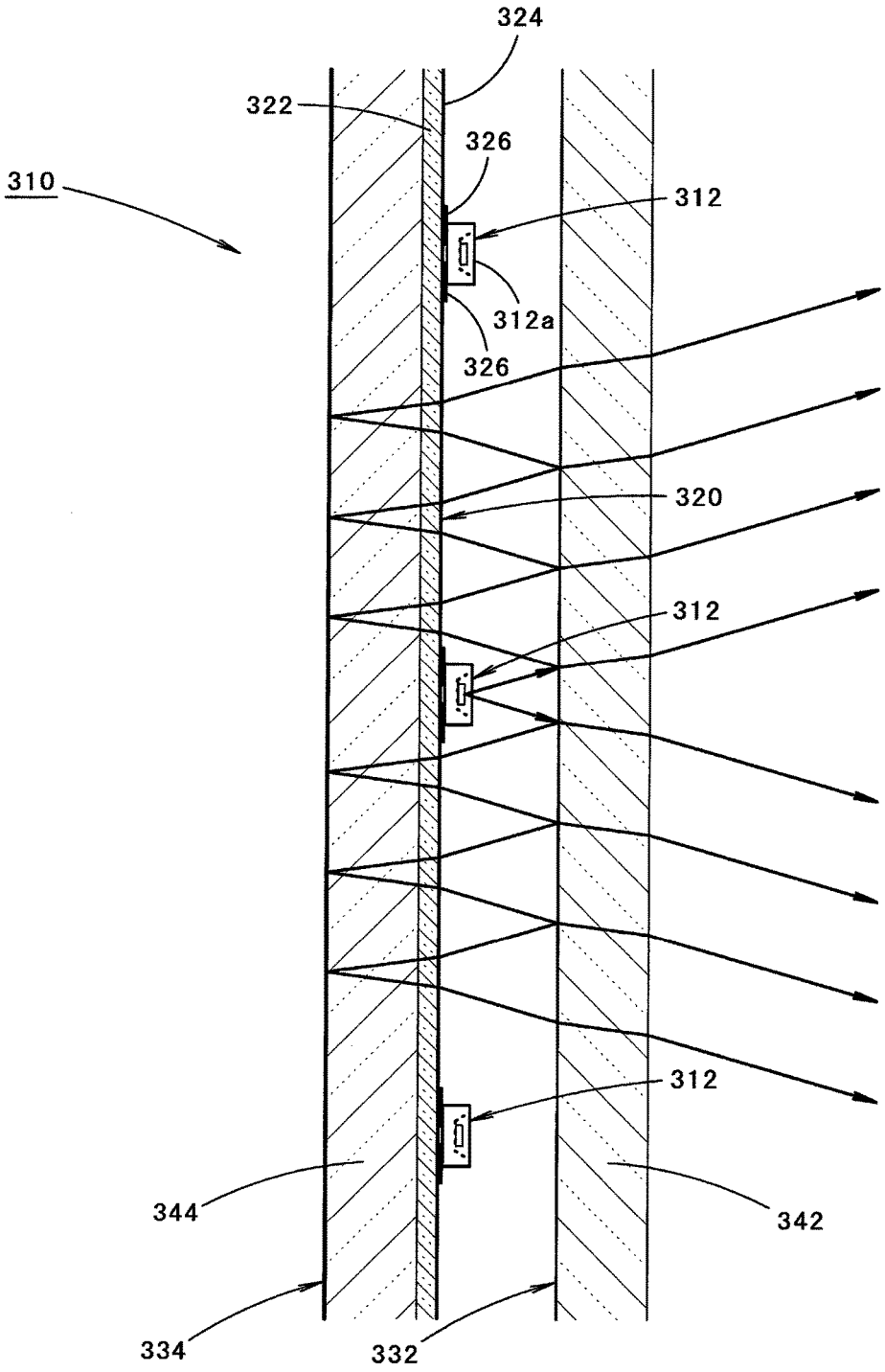
FIG. 7 is a similar view to FIG. 3 and shows an illumination unit of a third modification example of the first exemplary embodiment.

FIG. 7 is a similar view to FIG. 3 and shows a main part of an illumination unit 310 according to this modification example.

As shown in FIG. 7, a basic configuration of this modification example is similar to that of the first exemplary embodiment. However, in this modification example, a transparent substrate 320 and a plurality of light sources 312 are different in configuration from those of the first exemplary embodiment. Also, in this modification example, a first half mirror 332 is formed by applying a metal deposition process or the like to a rear surface of a transparent member 342, and a mirror 334 is formed by applying a metal deposition process or the like to a rear surface of a transparent member 344.

The transparent substrate 320 is configured so that a wiring pattern 324 is formed on a front surface of a substrate main body 322 made from a transparent resin (for example, PET). Also, land portions 326 are formed at plural positions on the wiring pattern 324.

The plurality of light sources 312 are mounted on the front surface of the transparent substrate 320 in a grid-like form vertically and horizontally. Then, the respective light sources 312 are fixed to the positions where the land portions 326 are formed, so as to be in electrical communication therewith the land portions 326.

These light sources 312 are light emitting diodes which emit red light. A ceramic case housing each light emitting chip is filled with a luminescent material. A surface of the luminescent material makes up a light emitting surface 312*a*.

The transparent member 342 is a plate-shaped member made from a transparent resin (for example, PET) and has constant thickness. The transparent member 342 is disposed so as to be separated a constant distance from the transparent substrate 320.

Additionally, the transparent member 344 is also a plate-shaped member from a transparent resin (for example, PET) and has a constant thickness. Then, the substrate main body 322 of the transparent substrate 320 is affixed to a front surface of the transparent member 344.

Light emitted from the respective light sources 312 makes up light which travels forward from the light emitting surface 312*a* thereof, and part of the light passes through the transparent member 342 to be directed forward, while the remaining part of the light is reflected by the first half mirror 332 which is formed on the rear surface of the transparent member 342. Then, the reflected light passes through the substrate main body 322 of the transparent substrate 320 and the transparent member 344, is reflected by the mirror 334 which is formed on the rear surface of the transparent member 344 to be emitted forward from the substrate main body 332, and reach the transparent member 342 again.

Namely, in this modification example, when the illumination unit 310 which is turned on is observed from the outside, light which is reflected multiple times between the first half mirror 332 and the mirror 334 causes an image I of each light source 312 to look as if a number of shining images of light source are aligned in the front-and-rear direction. On the other hand, when the illumination unit 310 which is not turned on is observed from the outside, the transparent substrate 320 and the plurality of light sources 312 which are mounted thereon can be made invisible by the presence of the first half mirror 332.

Next, a second exemplary embodiment of the invention will be described.

Figure 8:
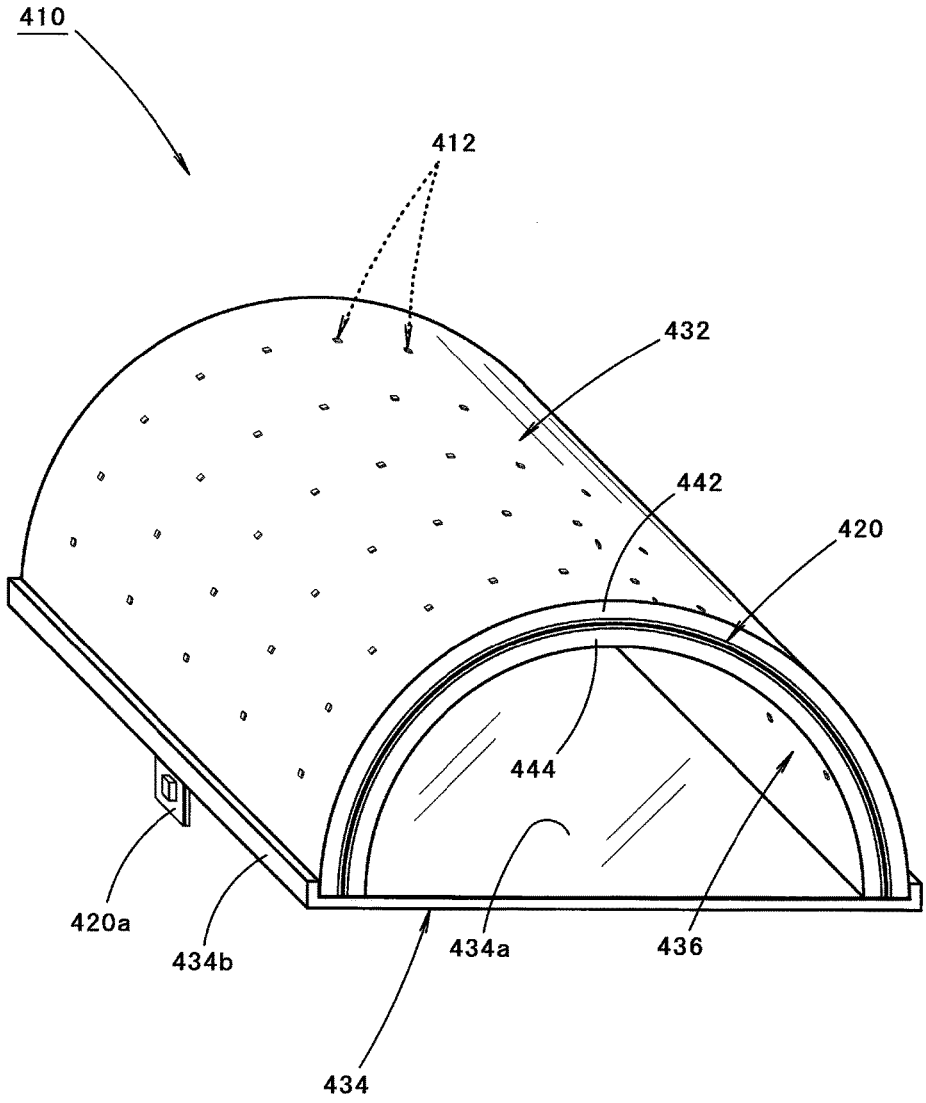
FIG. 8 is a perspective view showing an illumination unit according to a second exemplary embodiment of the patent application.

FIG. 8 is a perspective view showing an illumination unit 410 according to the second exemplary embodiment.

As shown in FIG. 8, the illumination unit 410 according to the second exemplary embodiment is configured in the following manner. That is, a transparent substrate 420 is an elongated semicylinder. A light transmitting member 442 is disposed on an outer circumferential surface side of the transparent substrate 420. A transparent member 444 is disposed on an inner circumferential surface side of the transparent substrate 420.

The configurations of the transparent substrate 420 and a plurality of light sources 412 which are mounted thereon are similar to those of the first exemplary embodiment.

The transparent members 442, 444 are both plate-like members made from a transparent resin (for example, PET) and are formed into a semicylinder having a constant thickness. The transparent member 442 is affixed to the transparent substrate 420. Specifically, an inner circumferential surface of the transparent member 442 is affixed to the transparent substrate 420. Also, the transparent member 444 is affixed to the transparent substrate 420. Specifically, an outer circumferential surface of the transparent member 444 is affixed to the transparent substrate 420.

A metal deposition process or the like is applied to an outer circumferential surface of the transparent member 442, whereby a first half mirror 432 is formed. Also, a metal deposition process or the like is applied to an inner circumferential surface of the transparent member 444, whereby a second half mirror 436 is formed.

The transparent substrate 420 and the transparent members 442, 444 are fixed to a mirror 434 at both end portions thereof in relation to a direction in which the transparent substrate 420 and the transparent members 442, 444 extend (that is, the semicylinders extend).

The mirror 434 is formed into a flat shape. A surface of the mirror 434 which faces the transparent substrate 420 is configured to serve as a mirror surface 434*a*. Flange portions 434*b* are formed at both side end portions of the mirror 434. The transparent substrate 420 and the transparent members 442, 444 are positioned by the pair of flange portions 434*b*. A tab 420*a* of the transparent substrate 420 is passed through an insertion hole (not shown) formed in the mirror 434.

Figure 9:
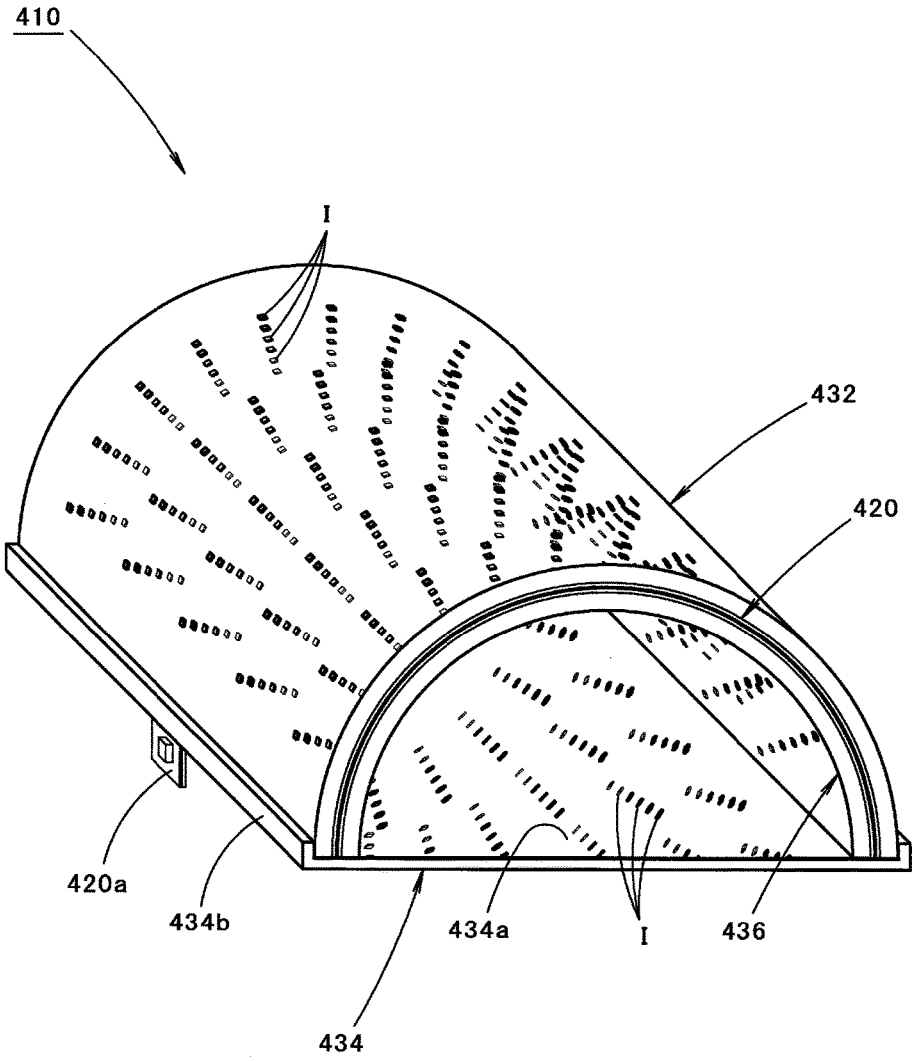
FIG. 9 is a similar view to FIG. 8 and shows how the illumination unit of the second exemplary embodiment operates.

FIG. 9 is a perspective view showing the illumination unit 410 in a state in which the light sources 412 are turned on.

As shown in FIG. 9, when the illumination unit 410 which is turned on is observed from the outside, light which is reflected multiple times between the first half mirror 432 causes an image I of each light source 412 to look as if a number of shining images of light sources are aligned in a radial fashion at a plurality of locations. Also, these images I cast a glare on the mirror surface 434*a* and can be seen.

On the other hand, as shown in FIG. 8, when the illumination unit 410 which is not turned on is observed from the outside, since outside light is reflected on the first half mirror 432, the transparent substrate 420 and the light sources 412 are almost invisible.

By adopting the configuration of the second exemplary embodiment, the light which is reflected multiple times between the first half mirror 432 and the second half mirror 436 causes the images I of the light sources 412 as if a number of shining images of light source images are aligned in a direction which is at right angles to the cylindrical surface. In addition, the mirror 434 causes the images I of the light sources 412 to look as if the number of images I of the light sources 412 increase multiple times in brightness.

In this second exemplary embodiment, it is assumed that the transparent substrate 420 is an elongated semicylinder. Alternatively, the transparent substrate 420 may be any other curved surface that elongates.

Also, in this second exemplary embodiment, it is assumed that the mirror surface 434*a* of the mirror 434 is formed into the flat shape. Alternatively, the mirror surface 434*a* may have a curved surface shape.

Next, a third exemplary embodiment of the invention will be described.

Figure 10:
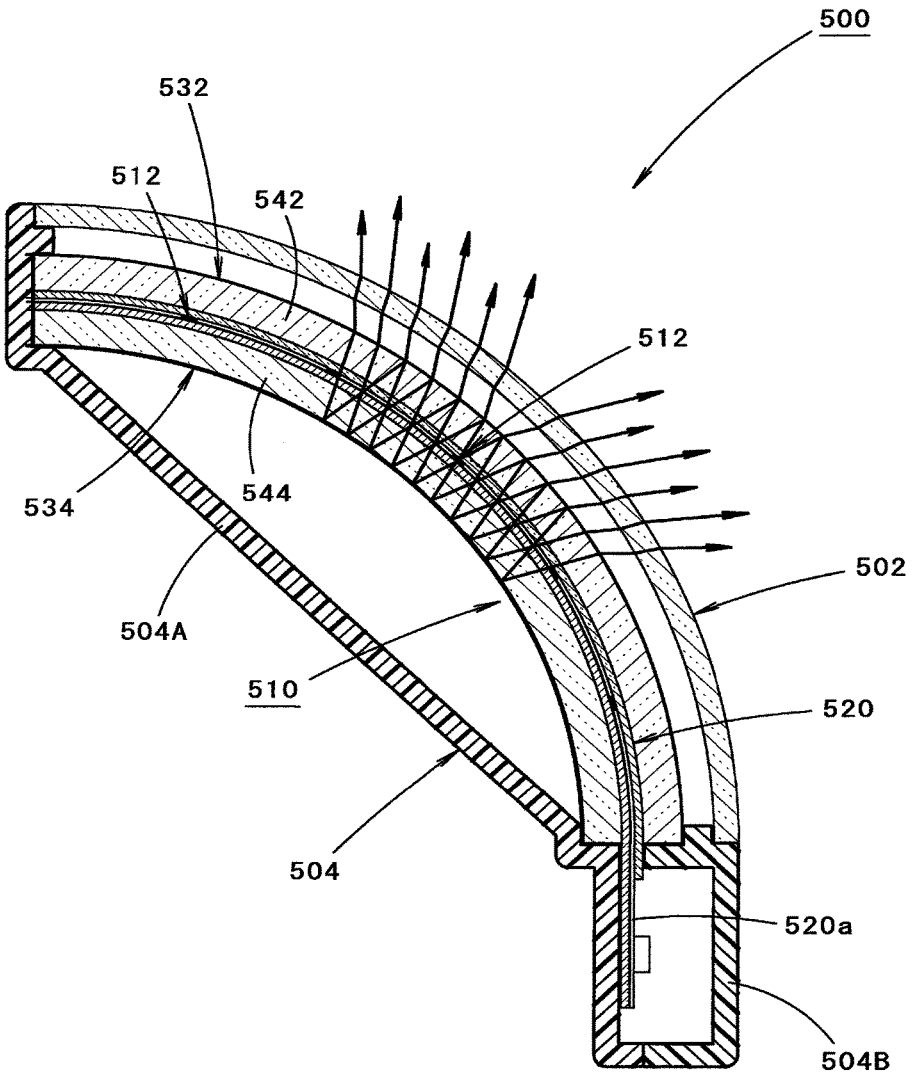
FIG. 10 is a side sectional view showing a vehicle lamp including an illumination unit according to a third exemplary embodiment of the invention.

FIG. 10 is a side sectional view showing a vehicle lamp 500 according to the third exemplary embodiment.

As shown in FIG. 10, the vehicle lamp 500 is a lamp such as a tail lamp, for example. The vehicle lamp 500 is configured so that a lamp chamber defined by a transparent cover 502 and a lamp body 504 houses an illumination unit 510.

The transparent cover 502 has a vertical sectional shape which extends along an arc-like curve.

The illumination unit 510 has a vertical sectional shape in which a transparent substrate 520 extends along the transparent cover 502 so as to have an arc-like shape. A transparent member 542 is disposed on an outer circumferential surface side of the transparent substrate 520. Also, a transparent member 544 is disposed on an inner circumferential surface side of the transparent substrate 520.

The configurations of the transparent substrate 520 and a plurality of light sources 512 which are mounted thereon are similar to those of the first exemplary embodiment.

The transparent members 542, 544 are both plate-shaped members made from a transparent resin (for example, PET), have a constant thickness, and have an arc shape in section. The transparent member 542 is affixed to the transparent substrate 520. Specifically, an inner circumferential surface of the transparent member 542 is affixed to the transparent substrate 520. Also, the transparent member 544 is affixed to the transparent substrate 520. Specifically, an outer circumferential surface of the transparent member 544 is affixed to the transparent substrate 520.

A metal deposition process or the like is applied to an outer circumferential surface of the transparent member 542, whereby a first half mirror 532 is formed. Also, a metal deposition process or the like is applied to an inner circumferential surface of the transparent member 544, whereby a mirror 534 is formed.

The transparent substrate 520 and the transparent members 542, 544 are fixed to the lamp body 504 at both end portions thereof in a direction in which the sectional arc shapes of the transparent substrate 520 and the transparent members 542, 544 extend. The lamp body 504 includes a lamp body main member 504A and a cover 504B. The cover 504B is attached to the lamp body main member 504A so as to cover a tab 520*a* of the transparent substrate 520.

By adopting the configuration of the third exemplary embodiment, when the illumination unit 510 which is turned on is observed from the outside through the transparent cover 502, light which is reflected multiple times between the first half mirror 532 and the mirror 534 causes an image I of each light sources 512 to look as if a number of shining images of light source images are aligned in radial directions.

On the other hand, when the illumination unit 510 which is not turned on is observed from the outside through the transparent cover 502, since outside light is reflected on the first half mirror 532, the transparent substrate 520 and the light sources 512 is almost invisible.

Next, modification examples of the third exemplary embodiment will be described.

Firstly, a first modification example of the third exemplary embodiment will be described.

Figure 11:
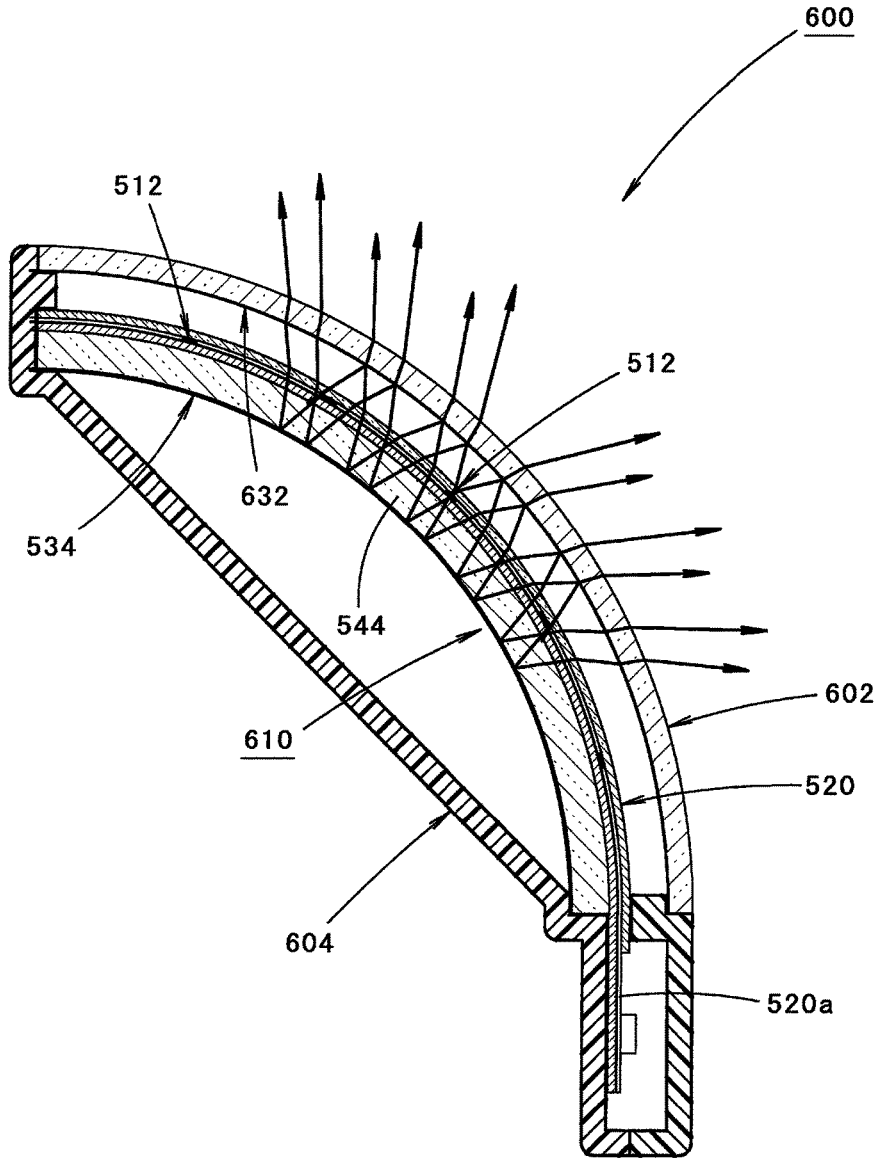
FIG. 11 is a similar view to FIG. 10 and shows a vehicle lamp of a first modification example of the third exemplary embodiment.

FIG. 11 is a similar view to FIG. 10 and shows a vehicle lamp 600 according to this modification example.

As shown in FIG. 11, a basic configuration of this modification example is similar to that of the third exemplary embodiment. However, this modification is different from the third exemplary embodiment in that a member corresponding to the transparent member 542 of the third exemplary embodiment is not provided and that a metal deposition process or the like is applied to an inner surface of a transparent cover 602, whereby a first half mirror 632 is formed. In association with this difference, the configuration of a lamp body 604 is partially different from that of the third exemplary embodiment.

By adopting the configuration of this modification example, when the illumination unit 610 which is turned on is observed from the outside through the transparent cover 602, light which is reflected multiple times between the first half mirror 632 and a mirror 534 causes an image I of each light source 512 to look as if a number of shining image of light source images are aligned in radial directions.

On the other hand, when the illumination unit 610 which is not turned on is observed from the outside through the transparent cover 602, since outside light is reflected on the first half mirror 632, a light emitting substrate 520 and the light sources 512 are almost invisible.

Also, by adopting the configuration of this modification example, the configuration of the vehicle lamp 600 can be simplified, and the vehicle lamp 600 can be made thin.

Next, a second modification example of the third exemplary embodiment will be described.

Figure 12:
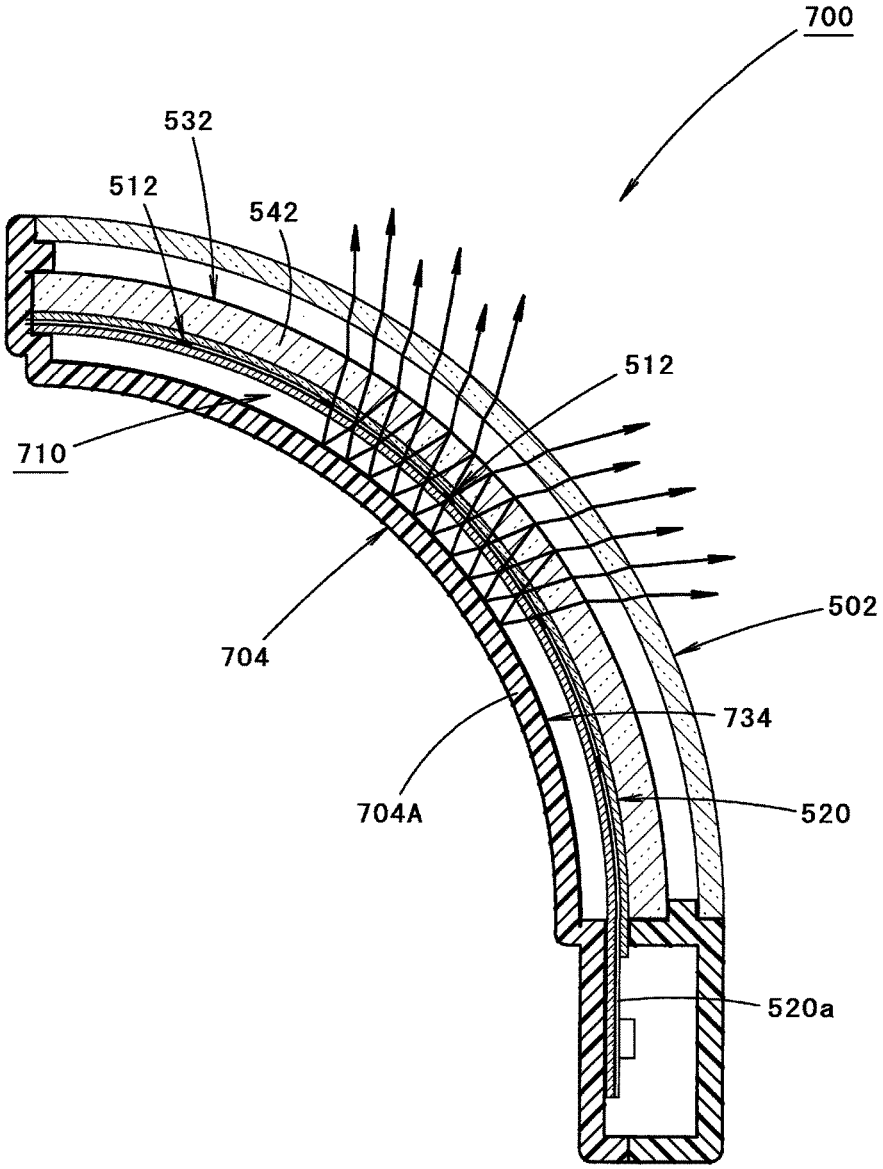
FIG. 12 is a similar view to FIG. 10 and shows a vehicle lamp of a second modification example of the third exemplary embodiment.

FIG. 12 is a similar view to FIG. 10 and shows a vehicle lamp 700 according to this modification example.

As shown in FIG. 12, a basic configuration of this modification example is similar to that of the third exemplary embodiment. However, this modification example is different from the third exemplary embodiment in that a member corresponding to the transparent member 544 of the third exemplary embodiment is not provided and that a lamp body 704 offers the function of the mirror 534 of the third exemplary embodiment.

Namely, the lamp body 704 of this modification example is configured so that a lamp body main member 704A extends to have an arc-like shape along a transparent substrate 520 in a vertical plane with a constant distance from the transparent substrate. A metal deposition process or the like is applied to an inner surface of the lamp body main member 704A, whereby a mirror 734 is formed.

By adopting the configuration of this modification example, when the illumination unit 710 which is turned on is observed from the outside through the transparent cover 502, light which is reflected multiple times between a first half mirror 532 and the mirror 734 causes an image I of each light sources 512 to look as if a number of shining images of light source images are aligned in radial directions.

On the other hand, when the illumination unit 710 which is not turned on is observed from the outside through the transparent cover 502, since outside light is reflected on the first half mirror 532, a light emitting substrate 520 and the light sources 512 are almost invisible.

Also, by adopting the configuration of this modification example, the configuration of the vehicle lamp 700 can be simplified, and the vehicle lamp 700 can be made thin.

Next, a fourth exemplary embodiment of the invention will be described.

Figure 13:
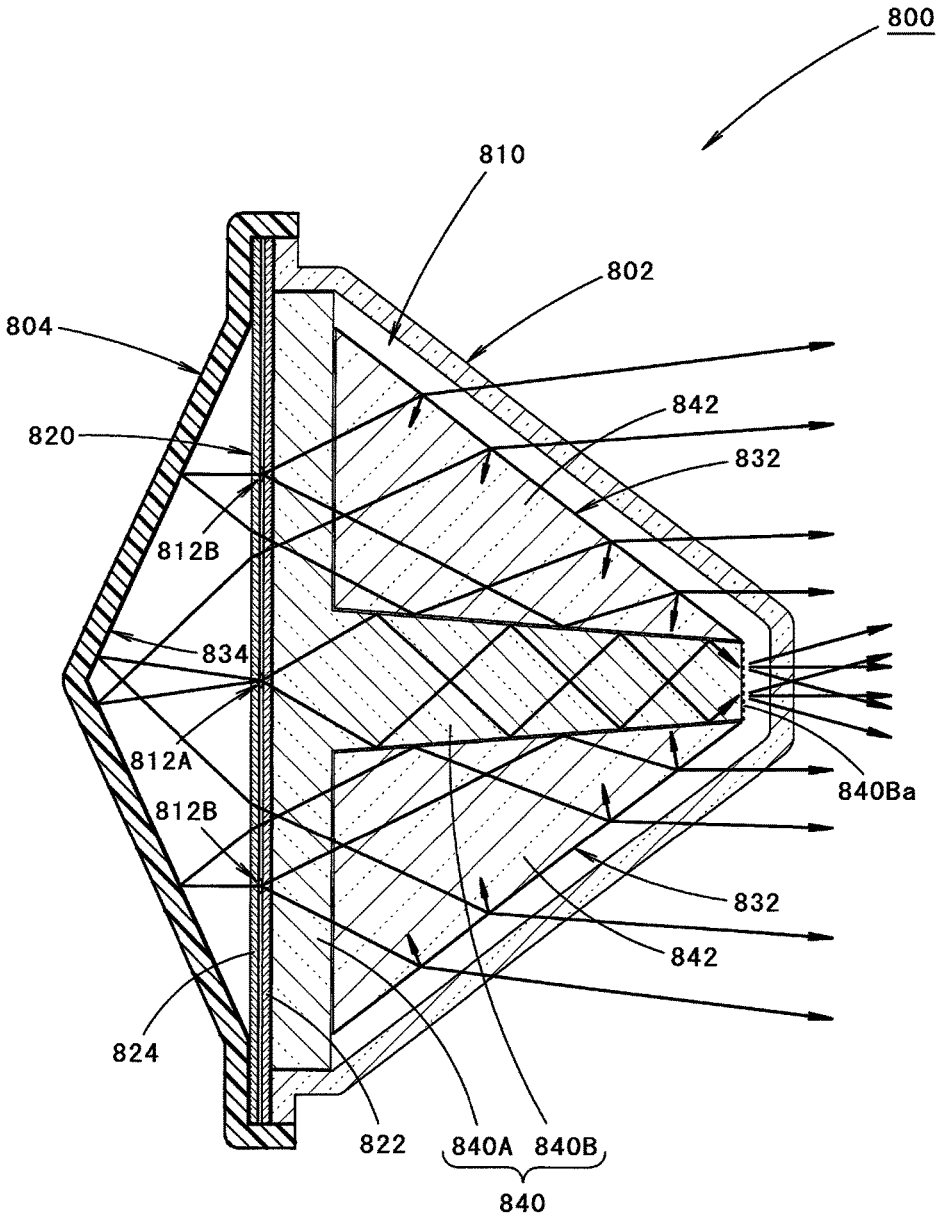
FIG. 13 is a side sectional view showing a vehicle lamp including an illumination unit according to a fourth exemplary embodiment of the invention.

FIG. 13 is a side sectional view showing a vehicle lamp 800 according to the fourth exemplary embodiment.

As shown in FIG. 13, the vehicle lamp 800 is a lamp such as a tail lamp, for example. The vehicle lamp 800 is configured so that a lamp chamber defined by a transparent cover 802 and a lamp body 804 houses an illumination unit 810.

The illumination unit 810 includes a transparent substrate 820, a plurality of light sources 812A, 812B, a transparent member 840, and a pair of upper and lower transparent members 842. The transparent substrate 820 is disposed so as to extend along a vertical plane. The light sources 812A, 812B are mounted on the transparent substrate 820. The transparent member 840 is disposed on a front side of the transparent substrate 820. The pair of upper and lower transparent members 842 are disposed in the vicinity of the transparent substrate 820. The illumination unit 810 has a vertically symmetrical shape.

Similar to the transparent substrate 20 of the first exemplary embodiment, the transparent substrate 820 is configured so that a wiring pattern is disposed between first and second transparent films 822, 824.

Figure 14A:
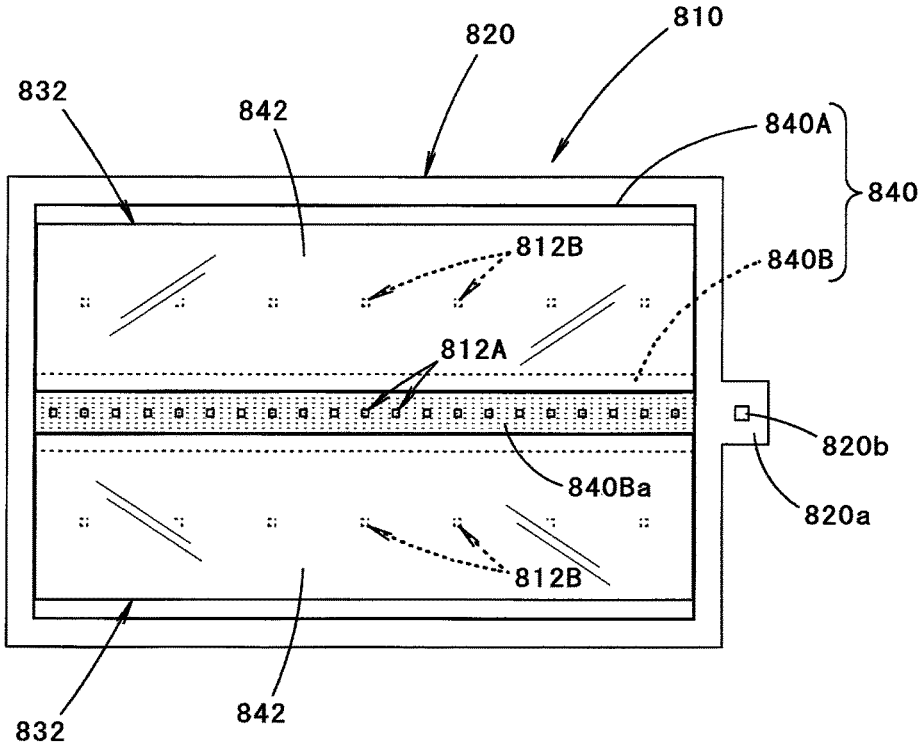
FIG. 14A is a front view showing the illumination unit according to the fourth exemplary embodiment.

FIG. 14A is a front view showing the illumination unit 810.

As shown in FIG. 14A, the plurality of light sources 812A are disposed at relatively short intervals in a right-and-left direction at a vertical central portion of the transparent substrate 820. The plurality of light sources 812B are disposed in positions which are vertically spaced away from the vertical central portion. Also, the light sources 812B are arranged in the right-and-left direction at intervals which are longer than those at which the plurality of light sources 812A are disposed.

The light sources 812A, 812B are light emitting diodes which emit red light and which are made up of light emitting chips each having light emitting surfaces on both front and rear surfaces thereof. The light sources 812A, 812B are fixed to the wiring pattern so as to be in an electrical connection therewith. The light sources 812A, 812B are disposed between the first and second transparent films 822, 824.

A tab 820*a* is formed at a side end portion of the transparent substrate 820 so as to project sideways. A terminal portion 820*b* of the wiring pattern is mounted on this tab 820*a*.

As shown in FIG. 13, the transparent member 840 includes a vertical plate-shaped portion 840A and a horizontal plate-shaped portion 840B. The vertical plate-shaped portion 840A extends in a vertical direction along a front surface of the transparent substrate 820. The horizontal plate-shaped portion 840B extends forward from a vertically central portion of the vertical plate-shaped portion 840A.

The vertical plate-shaped portion 840A is affixed to the transparent substrate 820. Specifically, a rear surface of the vertical plate-shaped portion 840A is affixed to the transparent substrate 820.

The horizontal plate-shaped portion 840B is formed so that a width in the vertical direction gradually decreases. A front end surface 840Ba of the horizontal plate-shaped portion 840B extends in the right-and-left direction to form an elongated thin strip. A light dispersion treatment such as embossing is applied to the front end surface 840Ba.

Each of the transparent members 842 is a triangular member which extends in the right-and-left direction along the vertical plate-shaped portion 840A and the horizontal plate-shaped portion 840B of the transparent member 840. Lower surfaces and rear surfaces of the transparent member 842 are in contact with the transparent member 840. A front surface of one of the transparent members 842 extends obliquely upward and rearward from the position of the front end surface 840Ba of the horizontal plate-shaped portion 840B to an upper end portion of the vertical plate-shaped portion 840A. A front surface of the other of the transparent members 842 extends obliquely downward and rearward from the position of the front end surface 840Ba of the horizontal plate-shaped portion 840B to a lower end portion of the vertical plate-shaped portion 840A.

A metal deposition process or the like is applied to the front surface of each transparent member 842, whereby a first half mirror 832 is formed.

One portion of the transparent cover 802 which is located in front of the horizontal plate-shaped portion 840B of the transparent member 840 extends in the right-and-left direction to form a thin elongated strip. Other portions of the transparent cover 802 located on upper and lower sides of the one portion of the transparent cover 802 extend rearward while being inclined obliquely upwards and obliquely downwards. The transparent cover 802 is in abutment with the transparent substrate 820 at upper and lower end portions of the transparent cover 802 while positioning the vertical plate-shaped portion 840A of the transparent member 840.

The lamp body 804 is spaced rearward away to some extent from the transparent substrate 820 at a vertically central portion of the lamp body 804. A part of the lamp body 804 extends forward and obliquely upward from the vertically central portion thereof toward an upper end portion of the lamp body 804. Another part of the lamp body 804 extends forward and obliquely downward toward a lower end portion of the lamp body 804. The lamp body 804 supports the transparent cover 802 in a state where the upper and lower end portions of the lamp body 804 and the transparent cover 802 sandwich the transparent substrate 820 therebetween.

A metal deposition process or the like is applied to a pair of upper and lower inclined surfaces which are located away from the transparent substrate 820 and which are parts of an inner surface of the lamp body 804. Thereby, a mirror 834 is formed.

As shown in FIG. 13, light emitted forward from the light sources 812 is mostly guided to the front end surface 840Ba while being internally reflected through total reflection on both upper and lower surfaces of the horizontal plate-shaped portion 840B of the transparent member 840 in a repeated fashion and is output forward from the front end surface 840Ba as diffused light.

On the other hand, light emitted rearward from the light sources 812A is reflected on the mirror 834 and is then output forward via the transparent substrate 820 and the transparent members 840, 842. As this occurs, part of the light is internally reflected on the first half mirror 832.

Also, light emitted forward from the light sources 812B is output forward via the transparent substrate 820 and the transparent members 840, 842. As this occurs, part of the light is internally reflected on the first half mirror 832.

Furthermore, light emitted rearward from the light sources 812B is reflected on the mirror 834 and is then output forward via the transparent substrate 820 and the transparent members 840, 842. As this occurs, part of the light is internally reflected on the first half mirror 832.

Figure 14B:
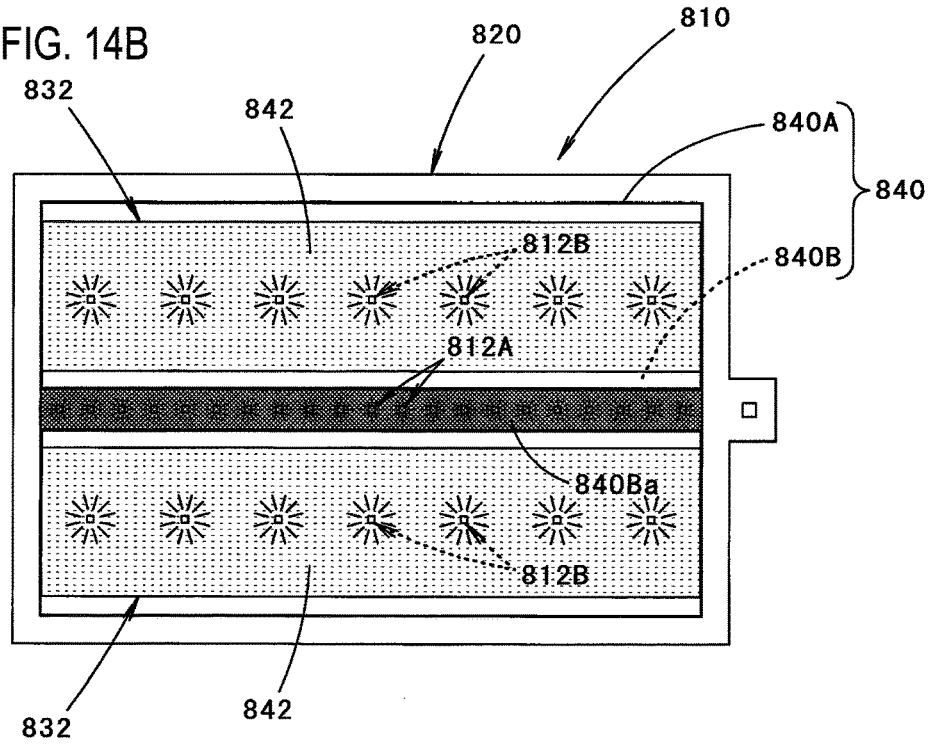
FIG. 14B is a front view showing how the illumination unit of the fourth exemplary embodiment operates.

FIG. 14B is a front view of the illumination unit 810 in such a state that the light sources 812A, 812B is turned on.

As shown in FIG. 14B, when the illumination unit 810 which is turned on is observed from the outside, the front end surface 840Ba of the horizontal plate-shaped portion 840B of the transparent member 840 looks to shine uniformly brightly, the pair of upper and lower transparent members 842 look to shine in a spotlight fashion at intervals in the right-and-left direction at a plurality of positions, and an entire area of the transparent members 842 looks to shine dimly.

As this occurs, the reason why the front end surface 840Ba of the horizontal plate-shaped portion 840B looks to shine uniformly brightly is that the large number of light sources 812A are disposed in the right-and-left direction and that most of the light emitted forward from the light sources 812A is guided to the horizontal plate-shaped portion 840B to be output forward from the front end surface 840Ba (an example of a light diffusion surface).

Also, the reason why the pair of upper and lower transparent members 842 look to shine at the plurality of positions thereof in the spotlight fashion at intervals in the right-and-left direction is that light emitted forward from the light sources 812B is output forward from the front surfaces of the transparent members 842. The front surfaces of the transparent members 842 are configured to serve as the first half mirror 832. An amount of light emitted is reduced by such an extent that the light is internally reflected. Therefore, the brightness at the respective positions is smaller than the brightness in the front end surface 840Ba of the horizontal plate-shaped portion 840B.

Furthermore, the reason why the entire areas of the pair of upper and lower transparent members 842 look to dimly shine is that light emitted rearward from the light sources 812A, 812B is reflected on the mirror 834 and is then output forward via the transparent substrate 820 and the transparent members 840, 842 and that light emitted forward or rearward from the light sources 812A, 812B is internally reflected on the first half mirrors 832, is then reflected repeatedly at different portions such as the mirror 834, and thereafter is output forward from the front surfaces of the transparent members 842.

Even in the case where the configuration of the fourth exemplary embodiment is adopted, when the illumination unit 810 which is turned on is observed from the outside through the transparent cover 802, the light including the light which are reflected multiple times between the first half mirrors 832 and the mirror 834 causes the whole areas of the pair of upper and lower transparent members 842 to look dimly shining. Furthermore, the front end surface 804Ba of the horizontal plate-shaped portion 840B of the transparent member 840 looks to shine uniformly brightly, and the pair of upper and lower transparent members 842 looks to shine at the plurality of positions in a spotlight fashion at intervals in the right-and-left direction.

On the other hand, when the illumination unit 810 which is not turned on is observed from the outside through the transparent cover 802, since outside light is reflected on the first half mirrors 832, the transparent substrate 820 and the light sources 812B are almost invisible. Also, since the front end surface 840Ba of the horizontal plate-shaped portion 840B is configured to serve as the light diffusion surface, the light sources 812A is almost invisible.

Next, a fifth exemplary embodiment of the invention will be described.

Figure 15:
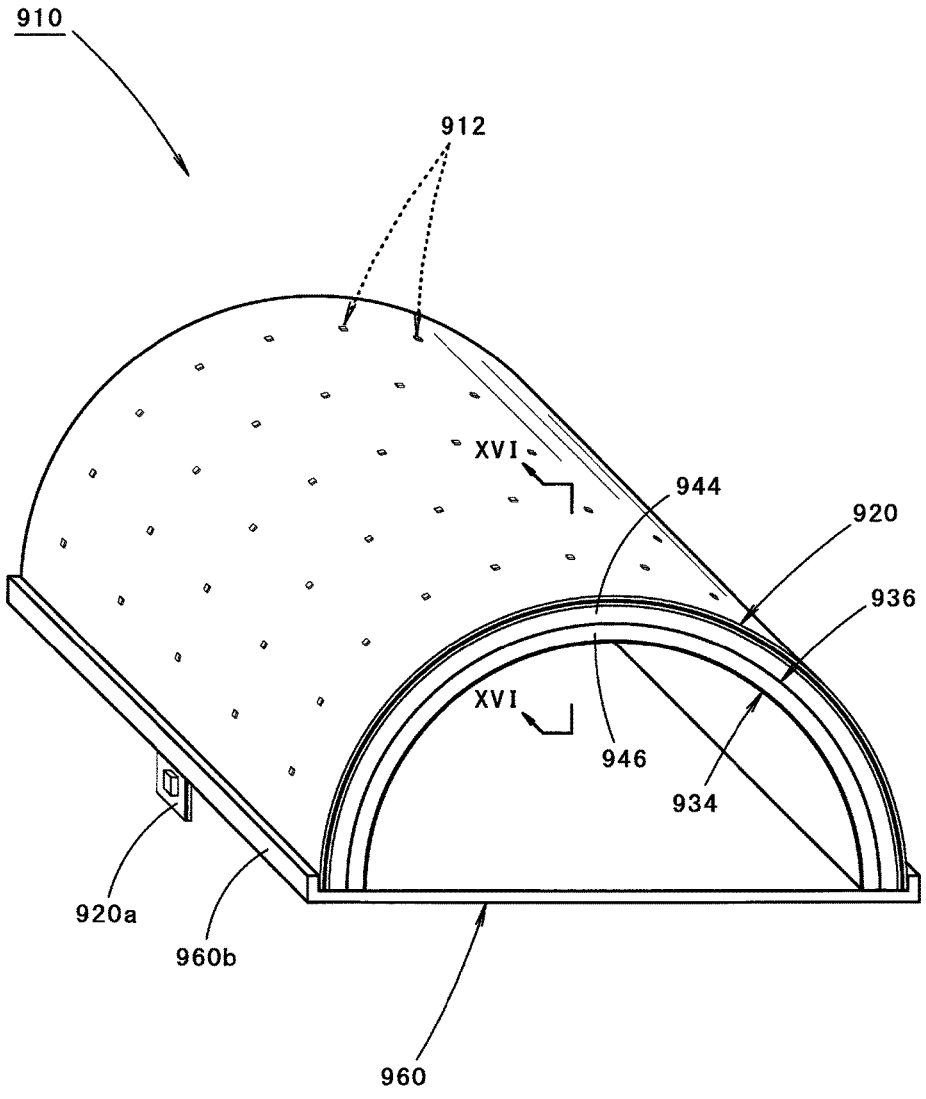
FIG. 15 is a perspective view showing an illumination unit according to a fifth exemplary embodiment of the invention.

FIG. 15 is a perspective view showing an illumination unit 910 according to the fifth exemplary embodiment of the invention.

As shown in FIG. 15, the illumination unit 910 according to the fifth exemplary embodiment is configured as follows similarly to the illumination unit 410 of the second exemplary embodiment. That is, a transparent substrate 920 is an elongated semicylinder. A transparent member 944 is disposed on an inner circumferential surface side of the transparent substrate 920. However, the fourth exemplary embodiment is different from the second exemplary embodiment in that a transparent member is not provided on an outer circumferential surface side of the transparent substrate 920 and that a transparent member 946 is further disposed on an inner circumferential surface side of the transparent member 944.

Figure 16:
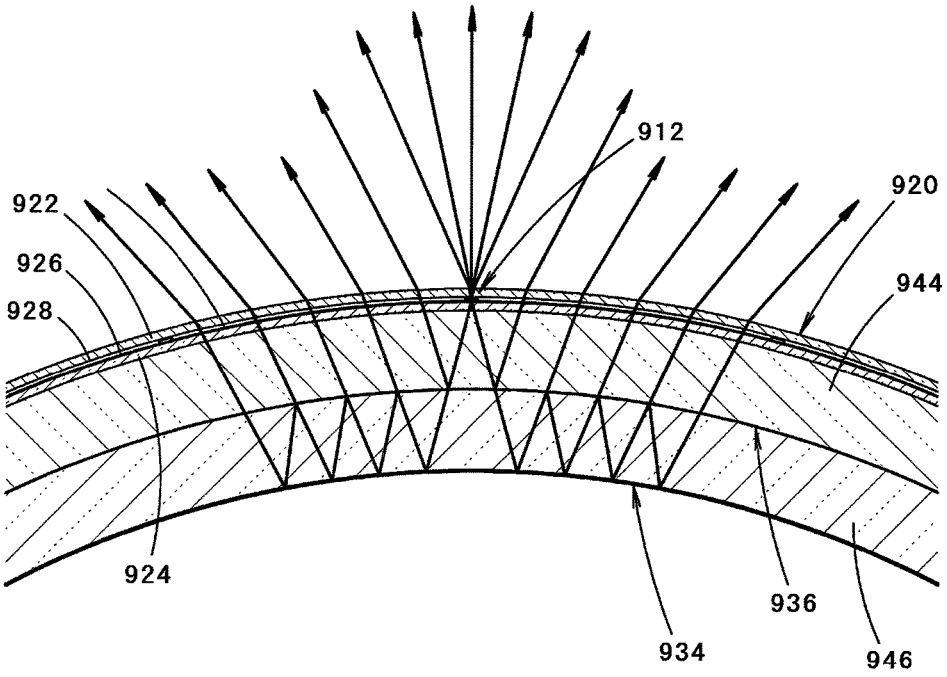
FIG. 16 is a detailed sectional view taken along a line XVI-XVI in FIG. 15.

FIG. 16 is a detailed sectional view taken along a line XVI-XVI in FIG. 15.

As shown in FIG. 16, the transparent substrate 920 is configured so that a wiring pattern 926 is disposed between first and second transparent films 922, 924 which are made from a transparent resin. The wiring pattern 926 is formed on an outer circumferential surface of the second transparent film 924 which is located on a rear side of the transparent substrate 920. The wiring pattern 926 is formed by cutting part of a transparent conductive film having a mesh shape. The first and second transparent films 922, 924 are affixed to each other via a transparent adhesive 928.

Each light source 912 is a light emitting diode which emit red light and which includes a minute light emitting chip having a light emitting surface on both front and rear surfaces thereof. The light sources 912 are fixed to the wiring pattern 926 in such a manner as to be in electrical communication with the wiring pattern 926 while being interposed between the first and second transparent films 922, 924.

The transparent members 944, 946 are plate-shaped members made from a transparent resin (for example, PET), are semicylinder, and have a constant thickness. The transparent member 944 is affixed to the transparent substrate 920. Specifically, an outer circumferential surface of the transparent member 944 is affixed to the transparent substrate 920. The transparent member 946 is affixed to the transparent member 944. Specifically, an outer circumferential surface of the transparent member 946 is affixed to the transparent member 944.

A metal deposition process or the like is applied to an inner circumferential surface of the transparent member 944, whereby a half mirror 936 is formed. Also, a metal deposition process or the like is applied to an inner circumferential surface of the transparent member 946, whereby a mirror 934 is formed.

As shown in FIG. 15, the transparent substrate 920 and the transparent members 944, 946 are fixed to a holder 960 at both end portions thereof in relation to a direction in which the semicylinders of the transparent substrate 920 and the transparent members 944, 946 extend.

The holder 960 has a plate plate-like shape. Flange portions 960*b* are formed a both side end portions of the holder 960. The transparent substrate 920 and the transparent members 944, 946 are positioned by the pair of flange portions 960*b*. A tab 920*a* of the transparent substrate 920 is inserted through an insertion hole (not shown) which is formed in the holder 960.

As shown in FIG. 16, light emitted from the light sources 912 towards an outer circumferential side is output to space on the outer circumferential side as it is.

On the other hand, light emitted from the light sources 912 towards an inner circumferential side reaches the half mirror 936 which constitutes the inner circumferential surface of the transparent member 944, whereupon part of the light is reflected on the half mirror 936 to be output to the space on the outer circumferential side via the transparent substrate 920, while the remaining light reaches the mirror 934 which constitutes the inner circumferential surface of the transparent member 946 as it is. Then, the light which is reflected on the mirror 934 is partially reflected on the half mirror 936, while the remaining light is output to the space on the outer circumferential side via the transparent substrate 920.

Figure 17:
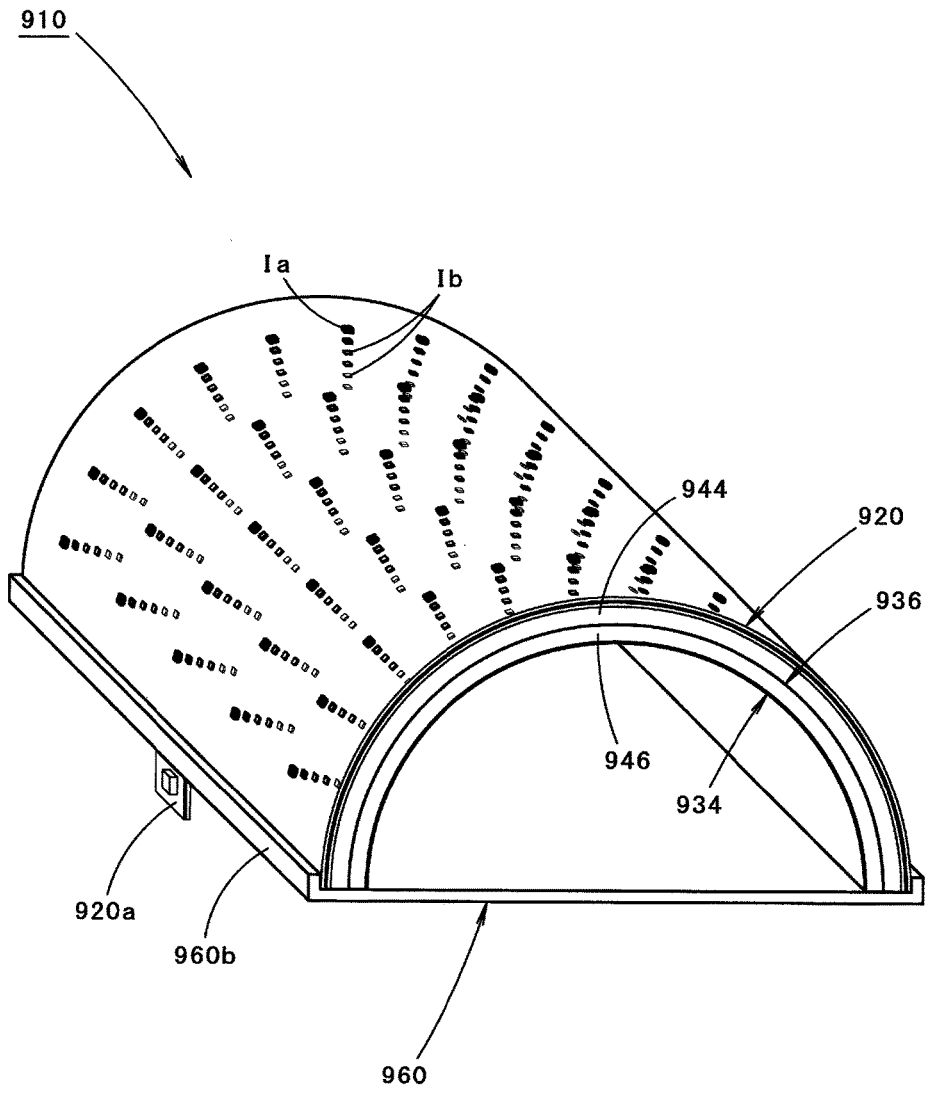
FIG. 17 is a similar view to FIG. 15 and shows how the illumination unit of the fifth exemplary embodiment operates.

FIG. 17 is a perspective view showing of the illumination unit 910 in which the light sources 912 are turned on.

As shown in FIG. 17, when the illumination unit 910 which is turned on is observed from the outside, the light which is emitted directly from the light sources 912 to the outer circumferential side causes an image Ia of each light source 912 to look to shine brightly. Also, the light which are reflected multiple times between the half mirror 936 and the mirror 934 causes the image of each light source 912 to look as if a number of images Ib of light sources shine at plural positions. As a result, the image of each light source 912 is caused to look as if the image Ia and the number of images Ib are aligned in radial directions in a series positional relationship.

On the other hand, as shown in FIG. 15, when the illumination unit 910 which is not turned on is observed from the outside, although the transparent substrate 920 is visible directly, since the wiring pattern 926 is formed by cutting part of the transparent conductive film having the mesh shape and the light sources 912 are made of the minute light emitting chips, the presence of the transparent substrate 920 is inconspicuous.

In the case where the configuration of the fifth exemplary embodiment is adopted, when the illumination unit 910 which is turned on is observed form the outside, the light which is emitted directly from the light sources 912 towards the outer circumferential side causes the image Ia of each light source to look to shine brightly. Also, the light which is reflected multiple times between the half mirror 936 and the mirror 934 causes the image of each light source 912 to look as if the number of illuminated images Ib shine at the plural positions. As a result, the image of each light source 912 is caused to look as if the image Ia and the number of images Ib are aligned in radial directions in a series positional relationship. Thereby it becomes possible to further improve the appearance of the illumination unit 910 when the illumination unit 910 is turned on.

Moreover, in the fifth exemplary embodiment, when the illumination unit 910 which is not turned on is observed from the outside, the presence of the light wiring pattern 926 and the light sources 912 of the transparent substrate 920 is inconspicuous. Thereby, the appearance of the illumination unit 910 can be improved not only when the illumination unit 910 is turned on but also when the illumination unit 910 is not turned on.

Also, in the fifth exemplary embodiment, the transparent member 944 (an example of a first transparent member) is disposed between the transparent substrate 920 and the half mirror 936. The transparent member 946 (an example of a second transparent member) is disposed between the half mirror 936 and the mirror 934. Therefore, a distance between the transparent substrate 920 and the half mirror 936 and a distance between the half mirror 936 and the mirror 934 can easily be maintained constant.

Further, in the fifth exemplary embodiment, the transparent substrate 920, the half mirror 936 and the mirror 934 are formed so as to extend along the curved surface which is convex forward. Therefore, the image of each light source 912 are caused to look as if the shining image Ia and the number of shining images Ib are aligned in the radial directions.

It should be noted that numerical values and parameters in the above exemplary embodiments and their modification examples are presented only as examples. These numerical numbers and parameters may, of course, be set to different ones as required.

Furthermore, the invention is not limited to the configurations described in the exemplary embodiments and their modification examples. Hence, other configurations may be obtained by modifying the exemplary embodiments and their modification examples.

What is claimed is:

1. An illumination unit comprising:

a transparent substrate;

a light source that is disposed within the transparent substrate;

a first half mirror that is disposed on a front side of the transparent substrate;

a mirror that is disposed on a rear side of the transparent substrate; and a wiring pattern that is formed in an interior of the transparent substrate and that is connected to the light source, wherein light emitted from the light source is repeatedly reflected between the first half mirror and the mirror while being transmitted through the transparent substrate, so as to be output forward from the first half mirror, wherein the light source emits light in a first direction through a front portion of the transparent substrate, wherein the light source further emits light in a second direction that is opposite to the first direction through a back portion of the transparent substrate, and wherein each of the transparent substrate, the first half mirror, and the mirror is a curved surface that is convex toward a front side of the illumination unit.

2. The illumination unit according to claim 1, further comprising:

a first transparent member that is disposed between the transparent substrate and the first half mirror, wherein the first transparent member is disposed so that a first surface of the first transparent member is in contact with the transparent substrate and a second surface of the first transparent member is in contact with the first half mirror.

3. The illumination unit according to claim 2, further comprising:

a second half mirror that is disposed between the transparent substrate and the mirror.

4. The illumination unit according to claim 3, wherein the transparent substrate, the first half mirror, and the second half mirror extend along a predetermined curved surface, and wherein end portions of the transparent substrate, end portions of the first half mirror, and end portions of the second half mirrors are fixed to the mirror.

5. The illumination unit according to claim 1, further comprising:

a second transparent member that is disposed between the transparent substrate and the mirror, wherein the second transparent member is disposed so that a first surface of the second transparent member is in contact with the transparent substrate and a second surface of the second transparent member is in contact with the mirror.

6. The illumination unit according to claim 1, further comprising:

a first transparent member that is disposed between the transparent substrate and the first half mirror; and a second transparent member that is disposed between the transparent substrate and the mirror, wherein the first transparent member is disposed so that a first surface of the first transparent member is in contact with the transparent substrate and a second surface of the first transparent member is in contact with the first half mirror, and wherein the second transparent member is disposed so that a first surface of the second transparent member is in contact with the transparent substrate and a second surface of the second transparent member is in contact with the mirror.

7. A vehicle lamp comprising:

the illumination unit according to claim 1;

a transparent cover; and a lamp body, wherein the transparent cover and the lamp body define a lamp chamber, wherein the lamp chamber houses the illumination unit, and wherein the transparent substrate and the first half mirror extend along the transparent cover.

8. The illumination unit according to claim 1, wherein the light source has light emitting surfaces on both front and rear surfaces thereof.

9. An illumination unit comprising:

a transparent substrate;

a light source that is mounted on the transparent substrate;

a half mirror that is disposed on a rear side of the transparent substrate;

a mirror that is disposed on a rear side of the half mirror; and a wiring pattern that is formed in an interior of the transparent substrate and that is connected the light source, wherein the light source emits light in a first direction through a front portion of the transparent substrate, wherein the light source emits light in a second direction that is opposite to the first direction through a back portion of the transparent substrate, and wherein each of the transparent substrate, the half mirror, and the mirror is a curved surface that is convex toward a front side of the illumination unit.

10. The illumination unit according to claim 9, further comprising:

a first transparent member that is disposed between the transparent substrate and the half mirror, and a second transparent member that is disposed between the half mirror and the mirror.

11. The illumination unit according to claim 9, wherein the light source has light emitting surfaces on both front and rear surfaces thereof.

* * * * *